US010494250B2

(12) United States Patent
Ware et al.

(10) Patent No.: US 10,494,250 B2
(45) Date of Patent: Dec. 3, 2019

(54) APPARATUS AND METHOD FOR PRESSURE DISPENSING OF HIGH VISCOSITY LIQUID-CONTAINING MATERIALS

(71) Applicant: Entegris, Inc., Billerica, MA (US)

(72) Inventors: Donald D. Ware, Woodbury, MN (US); Glenn M. Tom, Bloomington, MN (US); Amy Koland, Eden Prairie, MN (US); Dale Gene Mowrey, Montgomery, MN (US); Bruce Musolf, Eagan, MN (US)

(73) Assignee: ENTEGRIS, INC., Billerica, MA (US)

( * ) Notice: Subject to any disclaimer, the term of this patent is extended or adjusted under 35 U.S.C. 154(b) by 0 days.

(21) Appl. No.: 15/728,076

(22) Filed: Oct. 9, 2017

(65) Prior Publication Data

US 2018/0029865 A1 Feb. 1, 2018

Related U.S. Application Data

(63) Continuation of application No. 15/023,231, filed as application No. PCT/US2014/056020 on Sep. 17, 2014, now Pat. No. 9,802,807.

(Continued)

(51) Int. Cl.

*B67D 7/02* (2010.01)
*B67D 7/06* (2010.01)

(Continued)

(52) U.S. Cl.

CPC ..... *B67D 7/0261* (2013.01); *B65D 25/14* (2013.01); *B67D 7/06* (2013.01); *B65D 77/06* (2013.01); *B65D 81/3233* (2013.01)

(58) Field of Classification Search

CPC ..... B67D 7/0261; B67D 7/06; B65D 77/06; B65D 25/14; B65D 81/3233

See application file for complete search history.

(56) References Cited

U.S. PATENT DOCUMENTS 3,220,657 A 11/1965 Nyden
4,174,055 A 11/1979 Capra et al.

(Continued)

FOREIGN PATENT DOCUMENTS

CN 201895835 U 7/2011
CN 101484782 B 7/2013

(Continued)

*Primary Examiner* — Frederick C Nicolas
(74) *Attorney, Agent, or Firm* — Entegris, Inc.

(57) ABSTRACT

A liner-based pressure dispensing container includes a connector-mounted probe arranged to seat a dip tube against an inner surface of a liner fitment for sealing utility. A dip tube and probe may include increased and/or matched flow area. A reverse flow prevention element can be arranged proximate to a liquid extraction opening to inhibit reverse flow of liquid from a dip tube into a container. A liner-less container may include a reduce diameter lower portion arranged to receive a dip tube, with at least one associated sensor to sense a condition indicative of depletion of liquid from the lower portion. A shipping cap can be included for removing headspace gas from the liner. In one embodiment, the shipping cap is suitable for direct connection to a dispensing process.

6 Claims, 12 Drawing Sheets

Related U.S. Application Data

(60) Provisional application No. 61/880,330, filed on Sep. 20, 2013.

(51) Int. Cl.

| | |
|---|---|
| ***B65D 25/14*** | (2006.01) |
| *B65D 77/06* | (2006.01) |
| *B65D 81/32* | (2006.01) |

(56) References Cited

U.S. PATENT DOCUMENTS

| | | | | |
|---|---|---|---|---|
| 5,102,010 | A * | 4/1992 | Osgar | B65D 47/36 222/1 |
| 5,335,821 | A * | 8/1994 | Osgar | B65D 85/84 222/105 |
| 5,435,460 | A | 7/1995 | Osgar | |
| 5,526,956 | A | 6/1996 | Osgar | |
| 5,875,921 | A * | 3/1999 | Osgar | B67D 7/02 222/1 |
| 5,957,328 | A | 9/1999 | Osgar | |
| 6,015,068 | A * | 1/2000 | Osgar | B01J 4/00 222/105 |
| 6,077,356 | A | 6/2000 | Bouchard | |
| 6,170,720 | B1 | 1/2001 | Gnepper et al. | |
| 6,206,240 | B1 | 3/2001 | Osgar et al. | |
| 6,237,809 | B1 | 5/2001 | Kawai et al. | |
| 6,302,148 | B1 | 10/2001 | Imai | |
| 6,942,127 | B2 * | 9/2005 | Raats | B65D 77/067 137/212 |
| 6,955,185 | B2 | 10/2005 | Rauworth et al. | |
| 7,025,234 | B2 | 4/2006 | Priebe et al. | |
| 7,591,485 | B2 | 9/2009 | Simmons et al. | |
| 8,052,014 | B2 * | 11/2011 | Hasegawa | B67D 7/0261 137/212 |
| 8,336,734 | B2 | 12/2012 | Ware | |
| 8,602,270 | B2 | 12/2013 | Takanohashi | |
| 8,800,822 | B2 | 8/2014 | Good et al. | |
| 8,870,037 | B2 | 10/2014 | Takanohashi | |
| 8,899,452 | B2 | 12/2014 | Takanohashi | |
| 9,802,807 | B2 | 10/2017 | Ware et al. | |
| 2003/0075566 | A1 | 4/2003 | Priebe et al. | |
| 2003/0106907 | A1 | 6/2003 | Harrison et al. | |
| 2003/0205581 | A1 | 11/2003 | Wertenberger | |
| 2009/0020176 | A1 | 1/2009 | Hasegawa et al. | |
| 2009/0184733 | A1 | 7/2009 | Lilja | |
| 2009/0212071 | A1 | 8/2009 | Tom et al. | |
| 2010/0018994 | A1 | 1/2010 | Antheil et al. | |
| 2010/0112815 | A1 | 5/2010 | O'Dougherty et al. | |
| 2010/0133292 | A1 | 6/2010 | Ware et al. | |
| 2011/0215136 | A1 | 9/2011 | Ouillette | |
| 2013/0168410 | A1 | 7/2013 | Ware et al. | |
| 2014/0001205 | A1 | 1/2014 | Hodges et al. | |

FOREIGN PATENT DOCUMENTS

| | | | |
|---|---|---|---|
| JP | 2001-503106 | A | 3/2001 |
| JP | 2010-179954 | A | 8/2010 |
| JP | 2013-545676 | A | 12/2013 |
| WO | WO 2009/076101 | A1 | 6/2009 |
| WO | WO 2011/001646 | | 1/2011 |
| WO | 2012/051496 | A2 | 4/2012 |

* cited by examiner

APPARATUS AND METHOD FOR PRESSURE DISPENSING OF HIGH VISCOSITY LIQUID-CONTAINING MATERIALS

RELATED APPLICATION

This application is a continuation application of U.S. Ser. No. 15/023,231, filed Mar. 18, 2016, which claims the benefit of International Application No. PCT/US2014/056020, filed Sep. 17, 2014, which in turn claims priority to U.S. Provisional Patent Application No. 61/880,330, filed Sep. 20, 2013, all of which are incorporated by reference herein in their entireties for all purposes.

TECHNICAL FIELD

The present disclosure relates to fluid handling and dispensing systems, such as may be utilized for dispensing contents of liner-based containers. More specifically, various embodiments of the disclosure relate to dispensing of high viscosity liquid-containing materials (including, but not limited to, optically clear resin) using pressurized gas while minimizing or reducing bubble formation, and minimizing or reducing contact between such materials and an ambient environment. Certain embodiments relate to fabrication, use, and deployment of such systems.

BACKGROUND

In many industrial applications, chemical reagents and compositions are required to be supplied in a high purity state, and specialized packaging has been developed to ensure that the supplied material is maintained in a pure and suitable form, throughout the package fill, storage, transport, and dispensing operations.

In the fields of microelectronic device and display panel manufacturing, the need for suitable packaging is particularly compelling for a variety of liquids and liquid-containing compositions, as contaminants in the packaged material, and/or ingress of environmental contaminants to the contained material in the package, can adversely affect the microelectronic device and display panel products that are manufactured with such liquids or liquid-containing compositions, rendering the resulting products deficient or even useless for their intended use. Presence of bubbles in such liquids or liquid-containing compositions can have similar detrimental consequences.

As a result of these considerations, many types of high-purity packaging have been developed for liquids and liquid-containing compositions used in microelectronic device and display panel manufacturing, such as photoresists, etchants, chemical vapor deposition reagents, solvents, wafer and tool cleaning formulations, chemical mechanical polishing compositions, color filtering chemistries, overcoats, liquid crystal materials, etc.

One conventional type of packaging for high-purity materials includes a rigid, substantially rigid, or semi-rigid container (also known as an overpack) containing a liquid or liquid-based composition in a flexible liner or bag that is secured in position in the overpack by retaining structure such as a lid or cover. Such packaging is commonly referred to as "bag-in-can" (BIC), "bag-in-bottle" (BIB) and "bag-in-drum" (BID) packaging. Packaging of such general type is commercially available (e.g., under the trademark NOW-Pak®) from Advanced Technology Materials, Inc. (Danbury, Conn., USA).

In one embodiment, a liner comprises a flexible material, and the surrounding (e.g., overpack) container comprises a wall material that is substantially more rigid than said flexible material. Rigid or semi-rigid containers of the packaging may be formed (for example) of high-density polyethylene, or other polymer or metal, and the liner may be provided as a pre-cleaned, sterile collapsible bag of a polymeric film material, such as polytetrafluoroethylene (PTFE), low-density polyethylene, medium-density polyethylene, PTFE-based laminates, polyamide, polyester, polyurethane, or the like, selected to be inert to the material (e.g., liquid) to be contained in the liner. Multilayer laminates comprising any of the foregoing materials may be used. Examples of liners comprising multi-layer laminates are disclosed in U.S. Patent Application Publication No. 2009/0212071 A1, owned by the assignee of the present application, and which is hereby incorporated by reference herein in its entirety except for express definitions contained therein. Exemplary materials of construction of a liner further include: metalized films, foils, polymers/copolymers, laminates, extrusions, co-extrusions, and blown and cast films.

In use of liner-based packaging to dispense liquids and liquid-based compositions, a liquid or liquid-containing composition is commonly dispensed from the liner by connecting a dispensing assembly including a dip tube or short probe to a port of the liner, with the dip tube being immersed in the contained liquid. Fluid (e.g., gas) pressure is applied to the exterior surface of the liner (i.e., in the space between the liner and a surrounding container) to progressively collapse the liner and thereby force liquid through the dispensing assembly for discharge to associated flow circuitry to flow to an end-use tool or site. Use of a liner containing a liquid to be dispensed prevents direct contact with pressurized gas arranged to exert pressure against the liner, which may eliminate or substantially reduce dissolution of gas into liquid chemical to be dispensed to a point of use.

Certain liquids used in fabrication of electronic devices and/or display devices embody high viscosities (e.g., in a range of 250-35,000 centipoises or more), with examples of such liquids including optically clear resin ("OCR") materials and other useful resins such as polyimides (which may be used as protective overcoats, interlayer dielectrics, or passivation layers in microelectronic applications).

A traditional method of dispensing high viscosity process liquids has involved use of special transfer pumps and large diameter tubing. Extraction of liquid from supply containers using pumps limits piping configuration flexibility due to the desirability of positioning pumps below the level of supply containers to meet pump suction head requirements. Use of pumps may also significantly agitate liquids and lead to detrimental bubble formation.

It would be desirable to provide systems and methods for pressure dispensing of ultra-pure liquid-containing materials while overcoming various limitations associated with conventional apparatuses. The present disclosure relates to fluid and dispensing systems and methods that overcome various issues present in conventional systems.

SUMMARY

Various embodiments of the disclosure eliminates the presence of or need for wetted elastomeric seals (e.g., wetted O-rings) in a liner-based, liquid dispensing system during the dispensing of the resident liquid. Elimination of wetted elastomeric seals results in fewer parts and fewer machined components, thereby simplifying manufacturing, assembly, and maintenance (e.g., clean up) of the liquid dispensing system and improving reliability. The absence of wetted elastomeric seals also reduces transfer of trace metals to the dispensed fluid, as such trace metals can otherwise be present from the manufacturing process of the wetted elastomeric seals. Particle generation is also reduced, as the disclosed seals are substantially more static than those provided by elastomeric seals.

The improved fluid handling apparatuses and methods disclosed herein may be beneficially used with high viscosity materials including (but not limited to) optically clear resins. Such resins are useful, for example, for bonding various layers of electronic devices including liquid crystal displays (e.g., including but not limited to layers such as front panels, capacitive touch panels, and/or LCD panels). High viscosity materials as disclosed herein may have viscosity ranges on the order of 1000-50,000 centipoises or more.

In certain embodiments, fluid handling apparatuses and methods disclosed herein utilize liner-based pressure dispense containers with components arranged to reduce backpressure, promote simplified manufacture, promote high-integrity mechanical connections, and/or enable shipment of dip tube components inside liner-based pressure dispense containers with liners containing liquid chemical.

Certain strategies employed to reduce backpressure include increasing the flow area of fluid passages in dip tubes and connectors, reducing the number of transitions between different fluid conduits associated with a pressure dispense package, and reducing variations in flow area between different fluid conduits. Reduction in the number of transitions between fluid conduits may be accomplished, for example, by eliminating a dip tube coupling that might otherwise be intermediately arranged between a dip tube and probe. Reduction in variation of flow area between different fluid conduits may be accomplished by matching internal dimensions of adjacent components, and by moving sealing interfaces as close as possible to the inner diameter of adjacent conduits (e.g., utilizing face-type seals). For example, internal dimensions of fluid passages defined in a probe and dip tube may be matched in flow area (e.g., with variation in diameter or flow area of less than about 5%, less than about 3%, less than about 2%, less than about 1%, less than about 0.5%, or less than about 0.1%). It is beneficial to reduce pressure drops in transitions between fluid conduits conveying liquid chemicals (including high viscosity liquids such as OCR materials) to prevent formation of bubbles that may lead to defects if dispensed to tools for manufacturing microelectronic devices.

It has been observed by Applicants that high viscosity liquids are not particularly receptive to becoming saturated with dissolved gas even in direct exposure to gas at elevated pressures (e.g., pressurization gas), as diffusion coefficients are inversely proportional to viscosity. As compared with use of liner-based pressure dispense containers, direct contact between pressurized gas and liquid chemical in linerless pressure dispense containers can reduce pressurization requirements for pressurized gas, as dissipation of energy in liner friction is eliminated. Reduction of pressurization requirements may permit thinner-walled dispensing containers to be used, thereby reducing container costs and transit costs.

As noted previously herein, one strategy to reduce backpressure in the context of pressure dispensing includes increasing the flow area of passages in dip tubes and connectors. Although a large diameter dip tube is good to reduce pressure drop, if dispensing is interrupted and liquid chemical flows back through a dip tube into a container (e.g., due to gravity), then such reverse flow may introduce bubbles into the liquid, and such bubbles may be difficult to remove once entrained in high viscosity liquid. To address this issue, certain embodiments disclosed herein utilize a reverse flow prevention element associated with a dip tube to inhibit flow of liquid, from the dip tube into a container (or liner). In certain embodiments, a reverse flow prevention element may be arranged proximate to a liquid extraction opening within container (or liner). Examples of reverse flow prevention elements include float valves, flapper valves, butterfly check valves, and other check valves passive in operation.

Various methods may be used to detect when a liner-less pressure dispensing container is approaching an empty condition—including, but not limited to, sensing liquid level (e.g., by capacitive, conductive, ultrasonic, magnetic, or optical means including use of a sight glass), sensing weight (or change of weight) of a pressure dispense container, sensing presence of a first bubble in a dispensed liquid, or use of a totalizing flowmeter to sense aggregate amount of dispensed liquid.

Structurally, various embodiments may utilize a lower portion of a connector probe arranged to receive an upper end of a dip tube, with a lower edge of the probe arranged to seat or depress an upper portion of the dip tube against an inner surface of a liner fitment to sealingly engage the dip tube between the probe and the fitment. In various embodiments, the probe comprises a material (e.g., stainless steel or other suitably inert metal) characterized by significantly greater hardness than material of the dip tube (e.g., polyethylene, PTFE or other polymeric material), such that tightening the connector relative to the container neck causes a lower edge of the probe to plastically deform (e.g., leave an indentation in) the fitment to promote positive sealing, and to permit the probe to be re-used with a new liner after fluid contents of a first liner are depleted. In certain embodiments, a lower edge of a probe may be chamfered along an outer radius thereof.

In various embodiments, a pressure dispensing apparatus is disclosed, comprising a rigid container comprising a neck defining a container opening, a fitment retainer defining an aperture and arranged in or along the neck of the container, and a collapsible liner arranged within the container, the collapsible liner comprising an aperture-defining liner fitment retained by the fitment retainer. A downwardly-extending dip tube can be arranged within the liner, and a connector including a probe defining a fluid flow passage therethrough. In one embodiment, lower portion of the probe includes a stress concentrator arranged to directly engage an upper portion of the dip tube when the connector is secured to the neck of the rigid container to provide a liquid tight seal. The stress concentrator can comprise a continuous rib that projects radially outward from the probe. The stress concentrator of the probe can be arranged to seat an upper portion of the dip tube against an inner surface of the fitment to sealingly engage the dip tube between the probe and the fitment. In one embodiment, a reverse flow prevention element is associated with the dip tube. In some embodiments, the stress concentrator is located on the dip tube or the fitment instead of the probe. In one embodiment, the dip tube includes a stress concentrator that contacts the lower portion of the probe. In one embodiment, the dip tube includes a stress concentrator that contacts the fitment. In one embodiment, the fitment includes a stress concentrator that contacts the dip tube.

In certain embodiments, connection between a probe and dip tube are made upon addition of a connector to a liquid-containing container, such that a dip tube contacting the liquid may be shipped within the container to a point of use before the connector is mated with the dip tube-containing container.

In the use of liner-based packages for storage and dispensing of fluid materials, wherein the liner is mounted in an outer vessel or overpack (e.g., substantially rigid, but optionally semi-rigid), the dispensing operation often involves the flow of a pressure-dispense gas into the vessel, to a space exterior of the liner, so that pressure exerted by the gas forces the liner to progressively be compacted so that the fluid material in the liner is forced to flow out of the liner. A liner-based package can be coupled with a suitable pressurized gas source, such as a pump, compressor, a compressed gas tank, etc. The dispensed fluid material may be flowed to or through piping, manifolds, connectors, valves, etc. to a locus of use such as a fluid-utilizing process tool.

In various embodiments, a method is disclosed for removing headspace gas from a liner-based dispensing system. The method comprises: providing an overpack and a liner disposed in the overpack; providing a cap for coupling with the overpack, the cap defining a first port for fluid communication with an interior volume of a liner disposed in the overpack, the cap defining a second port for fluid communication with an interior of the overpack and an exterior of the liner; and providing a set of operating instructions on a tangible medium, the operating instructions comprising: filling the liner with a liquid; affixing the cap to the overpack; and pressurizing the second port while the first port is open to remove headspace gas from the liner via the first port. The operating instructions can further comprise: pressurizing the first port to a predetermined pressure with an inert gas supply; and closing the first port and the second port after the first port is pressurized to the predetermined pressure. In one embodiment, the inert gas supply in the operating instructions step of pressurizing the first port to the predetermined pressure is a nitrogen gas supply. The cap provided in the step of providing a cap can include a first fitting operatively coupled to the first port and a second fitting operatively coupled to the second port; at least one of the first fitting and the second fitting can be a Luer cap. Also, the overpack provided in the step of providing liner based dispensing system can be a rigid overpack.

In some embodiments, a method for removing headspace gas from a liner-based dispensing system is disclosed, comprising: providing an overpack and a liner disposed in the overpack; providing a cap for coupling with the overpack, the cap defining a first port and a second port for fluid communication with an interior of a liner disposed in the overpack, the cap defining a third port for fluid communication with an interior of the overpack and an exterior of the liner; providing a set of operating instructions on a tangible medium, the operating instructions comprising: applying a pressurized inert gas to the second port at a predetermined first pressure; and filling the liner with a liquid via the first port while applying the pressurized inert gas to the second port at the predetermined first pressure, the liquid being applied to the first port at a second pressure that is greater than the first pressure. In one embodiment, the operating instructions further comprise inflating the liner prior to the step of applying a pressurized inert gas to the second port. The operating instructions can further comprise: removing the pressurized inert gas from the second port; and capping the first port, the second port, and the third port. In one embodiment, the method further comprises collapsing the liner prior to the step of applying a pressurized inert gas to the second port. The step of collapsing the liner can comprise applying a pressure to the third port.

In various embodiments, a shipping cap for coupling to a liner-based dispensing container is disclosed, the shipping cap comprising a connector for operative coupling to a liner-based dispensing container. A gas removal probe is operatively coupled to the connector, the gas removal probe defining a liquid fill port and an inert gas port, wherein the gas removal probe of the shipping cap is configured to interface directly with a dispensing system. The shipping cap can further comprise an internal retainer disposed in the connector, the gas removal probe being captured between the connector and the internal retainer, and can also comprise an upper connector body and a lower connector body, the gas removal probe being captured between the upper connector body and the internal retainer. A base cap can connect the connector to a liner-based dispensing container. In one embodiment, the shipping cap further comprises a fitment retainer disposed in the connector for coupling between the probe and a fitment of a liner. The probe of the shipping cap can further include a stress concentrator for engagement with a dip tube of the liner-based dispensing container.

Liner-based packages can include a dispensing port that is in communication with the liner for dispensing of material therefrom. The dispensing port in turn is coupled with a suitable dispensing assembly. The dispensing assembly can take any of a variety of forms, e.g., an assembly including a probe or connector with a dip tube that contacts material in the liner and through which material is dispensed from the vessel. The package can be a large-scale package, wherein the liner has a capacity that ranges up to 2000 liters or more of material.

In various embodiments of the disclosure, the liner can be formed in any suitable manner, through use of one or more sheets of film or other material that may be sealed (e.g., welded) along edges thereof. In one embodiment, multiple flat sheets are superimposed (stacked) and sealed along edges thereof to form a liner. One or more sheets may include a port or cap structure along an upper portion of a face thereof. In another one embodiment, tubular blow molding is used with formation of an integral fill opening at an upper end of the vessel, which may be joined to a port or cap structure. The liner thus may have an opening for coupling of the liner to a suitable connector for fill or dispense operations involving respective introduction or discharge of fluid. Such opening may be reinforced with structure and termed a "fitment." A fitment typically includes a laterally extending flange portion to which thin film is joined, and a tubular portion extending in a direction substantially perpendicular to the flange portion. A liner fitment may mate with or otherwise contact a container port, container cap or closure, or other suitable structure. A cap or closure may also be arranged to couple with a dip tube for introduction or dispensation of fluid.

In various embodiments, the extrusion molded tube film can be sliced to form sheets that may be welded to form 2-D bags, or the extruded tube can have upper and lower portions joined thereto by welding. The films can be laminates. Sheets of different films may be welded together to form the components of the liner, e.g., side walls. The fitment may be sealed to the 2D and 3D bags at a seam or at any other point along the liner surface. The flexible liner can be blow molded, such as described in International Publication No. WO 2009/076101, owned by the assignee of the present application, and which is hereby incorporated by reference herein except for express definitions contained therein. Further the liner may be substantially rigid or self supporting (blow-molded), such as described in International Publication No. WO 2011/001646, owned by the assignee of the present application, and which is hereby incorporated by reference herein except for express definitions contained therein. In one embodiment, the liner and the overpack is co-blowmolded. In various embodiments, the substantially rigid liner defines a sump.

In certain embodiments, a liner may be formed from tubular stock material. By the use of a tubular stock, e.g., a blown tubular polymeric film material, heat seals and welded seams along the sides of the liner are avoided. The absence of side welded seams may be advantageous to better withstand forces and pressures that tend to stress the liner, relative to liners formed of flat panels that are superimposed and heat-sealed at their perimeter. In certain embodiments, a liner may be formed of tubular stock material that is cut lengthwise and subsequently welded to form one or more welded seams.

A liner can be a single-use, thin membrane liner, arranged to be removed after each use (e.g., when the container is depleted of the liquid contained therein) and replaced with a new, pre-cleaned liner to enable reuse of the outer container. Such a liner can be free of components such as plasticizers, antioxidants, UV stabilizers, fillers, etc. that may be or become a source of contaminants, e.g., by leaching into the liquid contained in the liner, or by decomposing to yield degradation products that have greater diffusivity in the liner and that migrate to the surface and solubilize or otherwise become contaminants of the liquid in the liner.

In various embodiments, a substantially pure film is utilized for the liner, such as virgin (additive-free) polyethylene film, virgin polytetrafluoroethylene (PTFE) film, or other suitable virgin polymeric material such as polyvinylalcohol, polypropylene, polyurethane, polyvinylidene chloride, polyvinylchloride, polyacetal, polystyrene, polyacrylonitrile, polybutylene, etc. More generally, the liner may be formed of laminates, co-extrusions, overmold extrusion, composites, copolymers and material blends, with or without metallization and foil. A liner material can be any suitable thickness, e.g., in a range from about 1 mils (0.001 inch) to about 120 mils (0.120 inch). In one embodiment, the liner has a thickness of 20 mils (0.020 inch).

In certain embodiments, a liner may be advantageously formed of a film material of appropriate thickness to be flexible and collapsible in character. In one embodiment, the liner is compressible such that its interior volume may be reduced to about 10% or less of the rated fill volume, i.e., the volume of liquid able to be contained in the liner when same is fully filled in the housing 14. In various embodiments, the interior volume of a liner may be compressible to about 0.25% or less of rated fill volume, e.g., less than 10 milliliters in a 4000 milliliter package, or about 0.05% or less (10 mL or less remaining in a 19 L package), or 0.005% or less (10 mL or less remaining in a 200 L package). In various embodiments, liner materials are sufficiently pliable to allow for folding or compressing of the liner during shipment as a replacement unit. The liner can be of a composition and character that is resistant to particle and microbubble formation when liquid is contained in the liner, that is sufficient flexible to allow the liquid to expand and contract due to temperature and pressure changes and that is effective to maintain purity for the specific end use application in which the liquid is to be employed, e.g., in semiconductor manufacturing or other high purity-critical liquid supply application.

In certain embodiments, a rigid or substantially rigid collapsible liner may be used. As used herein, the terms "rigid" or "substantially rigid" are meant to also include the characteristic of an object or material to substantially hold its shape and/or volume when in an environment of a first pressure, but wherein the shape and/or volume may be altered in an environment of increased or decreased pressure. The amount of increased or decreased pressure needed to alter the shape and/or volume of the object or material may depend on the application desired for the material or object and may vary from application to application. In one embodiment, at least a portion of a liner may be rigid or substantially rigid, and at least a portion of the liner is subject to collapse under pressure dispensing conditions by application of a pressurized fluid to or against at least a portion of such a liner. In one embodiment, a rigid or substantially rigid collapsible liner may be fabricated of material of sufficient thickness and composition for the liner to be self-supporting when filled with liquid. A rigid or substantially rigid collapsible liner may be of single-wall or multi-wall character, and can comprise polymeric materials. Laminated composites of multiple layers of polymeric materials and/or other materials (e.g., laminated by application of heat and/or pressure) may be used. A rigid or substantially rigid collapsible liner may be formed by any one or more suitable lamination, extrusion, molding, shaping, and welding steps. A rigid or substantially rigid collapsible liner can have a substantially rigid opening or port integrally formed with the liner, thus avoiding the need for a separate fitment to be affixed to the liner by welding or other sealing methods. Dispensing assemblies and dispensing apparatuses as disclosed herein may be used with rigid or substantially rigid collapsible liners.

In various embodiments of the disclosure, a collapsible liner may be disposed in a substantially rigid container (also known as a housing or overpack), which can be of a generally cylindrical shape, of a rectangular parallelepiped shape to promote stackability, or of any other suitable shape or conformation. A generally rigid housing may optionally include an overpack lid that is leak-tightly joined to walls of the housing, to bound an interior space containing the liner. An interstitial space provided between the liner and surrounding container may be in fluid communication with a pressurized gas source, such that addition of pressurized gas to the interstitial space compresses the liner to cause liquid to be expelled from the liner.

In certain embodiments, liquid-containing material may be maintained in a liner and overlaid with headspace containing inert gas. In other embodiments, liquid-containing material may be maintained in a liner with a zero-headspace or near-zero headspace conformation. As used herein, the term "zero headspace" in reference to fluid in a liner means that the liner is totally filled with liquid medium, and that there is no volume of gas overlying liquid medium in the liner. The term "near zero headspace" as used herein in reference to fluid in a liner means that the liner is substantially completely filled with liquid medium except for a very small volume of gas overlying liquid medium in the liner, e.g., the volume of gas is less than 5% of the total volume of fluid in the liner, being less than 3% of the total volume of fluid, or less than 2% of the total volume of fluid and or being less than 1% of the total volume of fluid, or less than 0.5% of the total volume of fluid (or, expressed another way, the volume of liquid or liquid-containing material in the liner is greater than 95% of the total volume of the liner, being more than 97% of such total volume, or more than 98% of such total volume, or more than 99% of such total volume, or more than 99.5% of such total volume). In certain embodiments headspace may be minimized or eliminated (i.e., in a zero or near-zero headspace conformation) with complete filling of the interior volume of the liner with liquid medium. In other embodiments, headspace may be necessary to accommodate expansion of contained material during shipment due to temperature variation, but headspace may be removed from the liner at the point of use prior to dispensation of liquid-containing material from the liner.

Various methods may be used to detect when a liner-based pressure dispensing container is approaching an empty condition—including, but not limited to, sensing weight (or change of weight) of a pressure dispense container, sensing presence of a first bubble in a dispensed liquid, use of a totalizing flowmeter to sense aggregate amount of dispensed liquid, sensing of liner strain or deformation, and sensing decay or "droop" of pressure of dispensed liquid. Use of pressure transducers or pressure switches to sense pressure droop conditions are disclosed in U.S. Patent Application Publication No. 2010/0112815 A1, owned by the assignee of the present application, and which is hereby incorporated by reference herein except for express definitions contained therein. It would be desirable to (i) reliably terminate dispensing prior full deletion of contents of a liner in order to prevent interruption of supply of fluid to a fluid-utilizing process tool, (ii) prevent bubbles from being dispensed to a fluid-utilizing process tool, and (iii) reduce the residual amount remaining in a depleted or "empty" container. Any one or more of the above-mentioned empty detection techniques may be used with liner-based pressure dispense containers as disclosed herein; however, sensing pressure of dispensed liquid (i.e., to identify a pressure droop condition) is particularly desirable due to its non-invasive character and reliable early warning of an approaching empty condition, and because such pressure sensing does not require knowledge of the weight or volume of the package and related components. First bubble detection may also be particularly undesirable in the context of dispensing high viscosity liquid to the difficulty of removing bubbles once entrained in such liquid.

For semiconductor or microelectronic device manufacturing applications, liquid-containing material contained in a liner of a pressure dispensing container as disclosed herein typically have less than 75 particles/milliliter (less than 50, or less than 35, or less than 20 particles/milliliter), of particles having a diameter of 0.2 microns or larger, at the point of fill of the liner. More recently, semiconductor manufacturers are specifying less than 5 particles/milliliter of particles having 0.1 microns diameter, and also less than 40 particles/milliliter of particles having 0.04 microns diameter. The liner can have less than 30 (in some instances less than 15) parts per billion total organic carbon (TOC) in the liquid, with less than 10 parts per trillion metal extractable levels per critical elements, such as calcium, cobalt, copper, chromium, iron, molybdenum, manganese, sodium, nickel, and tungsten, and with less than 150 parts per trillion iron and copper extractable levels per element for liner containment of hydrogen fluoride, hydrogen peroxide and ammonium hydroxide, consistent with the specifications set out in the Semiconductor Industry Association, International Technology Roadmap for Semiconductors (SIA, ITRS) 1999 Edition. Liquid-containing materials contained in liner-less pressure dispensing containers as disclosed herein may adhere to the same specifications.

Pressure dispensing apparatus can be employed for storage and dispensing of chemical reagents and compositions of widely varied character. Although embodiments of the disclosure are hereafter described primarily with reference to storage and dispensing of liquid or liquid-containing compositions for use in the manufacture of microelectronic device products, it will be appreciated that the utility of the invention is not thus limited, but rather extends to and encompasses a wide variety of other applications and contained materials. For example, such liquid containment systems have utility in numerous other applications, including medical and pharmaceutical products, building and construction materials, food and beverage products, fossil fuels and oils, agriculture chemicals, etc., where liquid media or liquid materials require packaging.

The term "microelectronic device" as used herein refers to resist-coated semiconductor substrates, flat-panel displays, thin-film recording heads, microelectromechanical systems, and other advanced microelectronic components. The microelectronic device may include patterned silicon wafers, flat-panel display substrates, polymeric substrates, or microporous/mesoporous inorganic solids.

In certain embodiments, a fluid handling apparatus may include a controller (e.g., including a microprocessor arranged to executed machine-readable instructions, such as may be embodied in a microcontroller, programmable logic controller, personal computer, distributed control system, or the like) arranged to receive inputs from one or more sensors, arranged to control operation of one or more valves or other flow control elements, and arranged to control operations such as starting and stopping of fluid dispensing, adjust fluid flow rate, changing of pressure dispense containers upon depletion, notify operators of abnormal conditions, manage material inventory requirements, and/or control operation of a liquid-utilizing process tool. In certain embodiments, a controller may automatically effectuate switchover of dispensing operation from a first pressure dispense container to a second pressure dispense container upon receipt of a signal indicating that the first pressure dispense container is approaching an empty condition—by terminating dispensation from the first pressure dispense container and initiating dispensation from the second pressure dispense container. In certain embodiments, a controller may control blending, dilution, or other liquid chemical manipulation at a point between a dispensing container and a process tool.

In certain embodiments, a pressure dispensing apparatus as disclosed herein may be arranged to receive pressurized gas from a pressurized gas source (e.g., to exert pressure directly or indirectly on liquid chemical to facilitate dispensation of liquid chemical from a container and/or container liner) and may be arranged to supply liquid to a downstream liquid-utilizing process tool optionally by way of intervening fluid lines and/or other components (e.g., empty detect sensors, reservoirs, etc.). When liner-less pressure dispensing containers are used, a gas inlet port may be arranged to communicate pressurized gas into an interior of the container to contact liquid arranged within the container to facilitate direct pressure dispensation of the liquid. When liner-based pressure dispensing containers are used, a gas inlet port may be arranged to communicate pressurized gas into a compression space between a liner and a rigid container wall to exert pressure against the liner and compress the liner to effectuate dispensation of liquid from the liner.

In certain embodiments, fluid handling apparatuses and methods disclosed herein utilize liner-less pressure dispense containers (i.e., including direct contact between pressurization gas and liquid chemical) with components arranged to reduce pressure requirements for pressurization gas, reduce backpressure, promote simplified manufacture, reduce reverse flow of liquid chemical, and/or facilitate detection of near-exhaustion of liquid chemical from a dispensing container.

In certain embodiments, a liner-less pressure dispensing container includes a reduced width lower portion, a dip tube including a liquid extraction opening arranged in the reduced width lower portion, and at least one level sensor arranged in or along the reduced width lower portion to provide indication of a condition indicating that the container is nearly depleted of liquid. The reduced width lower portion may have a cross-sectional area of less than about 50%, less than about 40%, less than about 30%, less than about 20%, or less than about 10% of a nominal width of an upper portion of the container. Benefit of providing a reduced width lower portion of a container include is to provide improved liquid level sensing capability and/or reducing amount of unrecoverable residual liquid chemical in the container when liquid dispensing is complete. A level sensing apparatus may be arranged external to the container (e.g., arranged to sense level proximate to the reduced width lower portion), or in some embodiments at least a portion of a level sensing apparatus may be arranged within or in fluid communication with an interior of the container. An optional scale or other weighing apparatus may further be arranged to sense weight of the container to provide information helpful in determining whether the container is nearly exhausted of liquid. The dip tube may further include a reverse flow prevention element, arranged proximate to a liquid extraction opening thereof.

In certain embodiments, an optional reservoir may be arranged between a pressure dispensing container and a point of use (e.g., liquid utilizing process tool) to permit continuing of dispensing operation while a depleted pressure dispensing container is replace with a new pressure dispensing container, and/or to promote removal of gas (e.g., gas bubbles) entrained in the liquid, such as by extracting liquid from a bottom of the reservoir and permitting gas to vent from a top of the reservoir.

In certain embodiments, a pressure dispensing apparatus may include a rigid container comprising a neck defining a container opening, a collapsible liner arranged within the container and including an aperture-defining liner fitment arranged in or along the neck of the rigid container, a downwardly-extending dip tube arranged within the liner, and a connector engaged to the neck of the rigid container and including a probe defining a fluid flow passage therethrough. A lower portion of the probe may be arranged to receive an upper end of the dip tube, and a lower edge of the probe may be arranged to seat an upper portion of the dip tube against an inner surface of the fitment to sealingly engage the dip tube between the probe and the fitment.

In certain embodiments, a fitment retainer may be positioned along the neck of the rigid container, with the fitment of a liner being retained within the neck of the container by the fitment retainer. In certain embodiments, a circumferential sealing element may be arranged along an outer wall of the probe to sealingly engage the fitment retainer. In certain embodiments, an upper end of the dip tube is positioned at or below an upper end of the fitment retainer. In certain embodiments, a connector may be define at least one gas flow passage arranged to permit fluid communication with a compression space between the collapsible liner and the rigid container. In certain embodiments, a first gas flow passage may be arranged to admit pressurized gas from an external pressurized gas source into the compression space; and a second gas flow passage may be arranged in fluid communication with a pressure relief valve to prevent overpressurization of the compression space. In certain embodiments, the dip tube defines interior passage comprising a first inner diameter, the fluid flow passage of the probe comprises a second inner diameter, and the second inner diameter is substantially equal to the first inner diameter. In certain embodiments, a dip tube may have an associated reverse flow prevention element.

In certain embodiments, a lower portion of a probe may be chamfered along an outer radius thereof. In certain embodiments, probe comprises a material (e.g., stainless steel) characterized by significantly greater hardness than material of the dip tube (e.g., polyethylene, PEEK, PTFE or other polymeric material), such that tightening the connector relative to the container neck causes a lower edge of the probe to plastically deform (e.g., leave an indentation in) the fitment to promote positive sealing, and to permit the probe to be re-used with a new liner after fluid contents of a first liner are depleted.

Certain embodiments include a connector for a liner-based pressure dispensing apparatus that includes a collapsible liner arranged within a rigid container with a fitment of the liner arranged to cooperate with a fitment retainer positioned along a neck of the rigid container, and includes a downwardly-extending dip tube arranged within the liner. The connector may include a body structure including an internally threaded lateral wall arranged to cooperate with an externally threaded portion of the neck of the rigid container, and may include an internal recess proximate to the internally threaded lateral wall. The connector may further include a probe defining a fluid flow passage through the probe, wherein a lower portion of the probe extends into the internal recess and is arranged to receive an upper end of a dip tube. A lower portion of the probe may be chamfered (e.g., tapered in thickness) along an outer radius thereof. A circumferential sealing element may be arranged along an outer wall of the probe above the lower portion in order to engage the fitment retainer when the connector is mated with the liner-based pressure dispensing apparatus. At least one gas flow passage may be arranged to permit fluid communication with a compression space between the collapsible liner and the rigid container when the connector is mated with the liner-based pressure dispensing apparatus. The chamfered lower edge of the probe may be arranged to seat an upper portion of the dip tube against an inner surface of the fitment to sealingly engage the dip tube between the probe and the fitment when the connector is mated with the liner-based pressure dispensing apparatus.

In certain embodiments, at least a lower portion of the probe may comprise stainless steel material, and at least an upper portion of the dip tube may comprises a polymeric material. In certain embodiments, a first gas flow passage may be arranged to admit pressurized gas from an external pressurized gas source into the compression space; and a second gas flow passage may be arranged in fluid communication with a pressure relief valve to prevent overpressurization of the compression space. In certain embodiments, the upper end of the dip tube may be positioned at or below an upper end of the fitment retainer.

Certain embodiments are directed to a method for dispensing liquid-containing material utilizing pressure dispensing apparatus that includes a rigid container with a neck defining a container opening, a collapsible liner arranged within the container and including an aperture-defining liner fitment arranged in or along the neck of the rigid container, a downwardly-extending dip tube arranged within the liner, and a connector including a probe defining a fluid flow passage through the probe. The method may include threadably engaging the connector to the neck of the rigid container to cause a lower edge of the probe to seat an upper portion of the dip tube against an inner surface of the dip tube to sealingly engage the dip tube between the probe and fitment; and supplying pressurized gas through the connector to a compression space between the collapsible liner and the rigid container to compress the collapsible liner. In certain embodiments, the method may further include comprising removing a cap from the neck of the rigid container to expose a portion of the liner fitment and to expose a portion of the dip tube retained by the liner fitment before threadably engaging the connector to the neck of the rigid container. In certain embodiments, the foregoing cap removal and connector engagement steps may be performed in a cleanroom environment. In various embodiments, the steps of the method are provided as instructions on a tangible medium, such as a paper document or electronic or computer-readable file.

In certain embodiments, a pressure dispensing apparatus may include a rigid container with a neck defining a container opening, a fitment retainer defining an aperture and arranged in or along the neck of the container, a collapsible liner arranged within the container and including an aperture-defining liner fitment retained by the fitment retainer, a downwardly-extending dip tube arranged within the liner; and a connector including a probe defining a fluid flow passage through the probe. A lower portion of the probe may be arranged to directly engage an upper portion of the dip tube without an intervening dip tube coupling when the connector engages the neck of the rigid container. The pressure dispensing apparatus may further include at least one of the following features (a) and (b): (a) an inner diameter of a flow passage defined in the probe is at least about 65% of an inner diameter of a portion of the liner fitment arranged within the aperture of the fitment retainer; and (b) an inner diameter a flow passage defined in each of the probe and the dip tube is at least 0.62 inches. In certain embodiments, a pressure dispensing apparatus includes both features (a) and (b). Such dimensional thresholds render the apparatus particularly suitable for dispensing high viscosity liquids (e.g., having viscosity in a range of 1000-50,000 centipoises, or from 3000-30,000 centipoises in certain embodiments). In certain embodiments, a lower edge of the probe (which may be fabricated of stainless steel material) may be arranged to seat an upper portion of the dip tube (which may be fabricated of polymeric material) against an inner surface of the fitment to sealingly engage the dip tube between the probe and the fitment. In certain embodiments, the sealing engagement may include plastic deformation of an upper portion of the dip tube by a lower edge of the probe. In certain embodiments, a reverse flow prevention element may be associated with a dip tube.

Certain embodiments include methods that utilize a pressure dispensing apparatus including a rigid container with a neck defining a container opening, a collapsible liner arranged within the container with an aperture-defining liner fitment arranged in or along the neck of the rigid container, a downwardly-extending dip tube arranged within the liner, and a connector including a probe defining a fluid flow passage through the probe. Method steps may include threadably engaging the connector to the neck of the rigid container to cause a lower edge of the probe to directly engage an upper portion of the dip tube without an intervening dip tube coupling; and supplying pressurized gas through the connector to a compression space between the collapsible liner and the rigid container to compress the collapsible liner. In certain embodiments, the method may further include removing a cap from the neck of the rigid container to expose a portion of the liner fitment and to expose a portion of the dip tube retained by the liner fitment before threadably engaging the connector to the neck of the rigid container, following shipment of the dip tube sealed within the container by the cap. In various embodiments, the steps of the method are provided as instructions on a tangible medium, such as a paper document or electronic or computer-readable file.

In certain embodiments, a pressure dispensing apparatus may include a container comprising a mouth along a top surface, an upper portion having a first width, and a lower portion having a second width that is smaller than the first width; a downwardly-extending dip tube including a liquid extraction opening arranged in the lower portion of the container; and at least one of the following features (a) and (b): (a) a reverse flow prevention element may be arranged proximate to the liquid extraction opening to inhibit flow of liquid from the dip tube into the container; and (b) a sensor may be provided in or proximate to the lower portion of the container to sense a condition indicative of absence or low level of liquid in the lower portion of the container. In certain embodiments, a pressure dispensing apparatus may include both features (a) and (b). In certain embodiments, a reverse flow prevention element may include a float valve or a butterfly check valve. In certain embodiments, a sensor may be provided in or proximate to the lower portion of the container to sense a condition indicative of absence or low level of liquid in the lower portion of the container. In certain embodiments, such sensor may include a level sensor or any suitable type. In certain embodiments, such sensor may include a capacitive, conductive, ultrasonic, magnetic, or optical sensor. In certain embodiments, such sensor may be arranged external to the container. In certain embodiments, at least a portion of a sensor may be arranged within or in fluid communication with an interior of the container. In certain embodiments, a pressure dispensing apparatus may be adapted to initiate dispensing of liquid from an other container responsive to sensing of a condition indicative of absence or low level of liquid in the lower portion of the container. In certain embodiments, a pressure dispensing container may include a gas inlet port arranged to communicate pressurized gas into an interior of the container to contact liquid arranged within the container to facilitation liner-less pressure dispensation of the liquid.

Certain embodiments relating to a method for reducing presence of bubbles within a fluid stream dispensed from a pressure dispense container, including: supplying pressurized gas to the interior of a rigid container to directly contact liquid chemical arranged within the interior, thereby causing liquid chemical to flow into the extraction opening of a dip tube, wherein the extraction opening is arranged within a lower portion of the container that comprises a reduced width relative to an upper portion of the container; and performing at least one of the following steps (a) and (b): (a) inhibiting backflow of the liquid chemical within the dip tube utilizing a reverse flow prevention element associated with the dip tube; and (b) sensing a condition indicative of absence or low level of liquid chemical in the lower portion of the container. In certain embodiments, both steps (a) and (b) may be performed.

In certain embodiments, a pressure dispensing apparatus may include a container with a mouth along a top surface;

a downwardly-extending dip tube including a liquid extraction opening arranged in the lower portion of the container; a gas inlet port arranged to communicate pressurized gas into an interior of the container to contact liquid arranged within the container; and a reverse flow prevention element arranged proximate to the liquid extraction opening to inhibit flow of liquid from the dip tube into the container In certain embodiments, a rigid container (whether or not containing a liner) may be fabricated of non-porous metal (as opposed to potentially porous material such as certain polymers) to minimize or eliminate migration of ambient environment gas or vapor into the container. In certain embodiments, a connector as disclosed herein may comprise a body and/or probe fabricated of metal (e.g., stainless steel) to similarly minimize or eliminate migration of ambient environment gas or vapor.

In certain embodiments, the liquid-containing material comprises any of the following: photoresists, etchants, chemical vapor deposition reagents, solvents, wafer cleaning formulations, tool cleaning formulations chemical mechanical polishing compositions, color filtering chemistries, overcoats, liquid crystal material, and optically clear resins.

Further details of exemplary embodiments are explained below in connection with the figures.

Structurally, in various embodiments, a pressure dispensing apparatus comprises a rigid container comprising a neck defining a container opening; a collapsible liner arranged within the container, the collapsible liner comprising an aperture-defining liner fitment arranged in or along the neck of the rigid container; a downwardly-extending dip tube arranged within the liner; a connector engaged to the neck of the rigid container and including a probe defining a fluid flow passage therethrough, wherein a lower portion of the probe is arranged to receive an upper end of the dip tube, and wherein a lower edge of the probe is arranged to seat an upper portion of the dip tube against an inner surface of the fitment to sealingly engage the dip tube between the probe and the fitment.

In some embodiments, a connector for a liner-based pressure dispensing apparatus includes a collapsible liner arranged within a rigid container with a fitment of the liner arranged to cooperate with a fitment retainer positioned along a neck of the rigid container, and including a downwardly-extending dip tube arranged within the liner, the connector comprising: a body structure including an internally threaded lateral wall arranged to cooperate with an externally threaded portion of the neck of the rigid container, and including an internal recess proximate to the internally threaded lateral wall; a probe defining a fluid flow passage therethrough, wherein a lower portion of the probe extends into the internal recess and is arranged to receive an upper end of a dip tube, wherein a lower portion of the probe is chamfered along an outer radius thereof, and wherein a circumferential sealing element is arranged along an outer wall of the probe above the lower portion in order to engage the fitment retainer when the connector is mated with the liner-based pressure dispensing apparatus; and at least one gas flow passage arranged to permit fluid communication with a compression space between the collapsible liner and the rigid container when the connector is mated with the liner-based pressure dispensing apparatus; wherein the chamfered lower edge of the probe is arranged to seat an upper portion of the dip tube against an inner surface of the fitment to sealingly engage the dip tube between the probe and the fitment when the connector is mated with the liner-based pressure dispensing apparatus.

In various embodiments, a method for dispensing liquid-containing material utilizing pressure dispensing apparatus comprises (a) a rigid container including a neck defining a container opening, (b) a collapsible liner arranged within the container and comprising an aperture-defining liner fitment arranged in or along the neck of the rigid container, (c) a downwardly-extending dip tube arranged within the liner, and (d) a connector including a probe defining a fluid flow passage therethrough, the method comprising: threadably engaging the connector to the neck of the rigid container to cause a lower edge of the probe to seat an upper portion of the dip tube against an inner surface of the dip tube to sealingly engage the dip tube between the probe and fitment; and supplying pressurized gas through the connector to a compression space between the collapsible liner and the rigid container to compress the collapsible liner. In various embodiments, the steps of the method are provided as instructions on a tangible medium, such as a paper document or electronic or computer-readable file.

In some embodiments, a pressure dispensing apparatus comprises a rigid container comprising a neck defining a container opening; a fitment retainer defining an aperture and arranged in or along the neck of the container; a collapsible liner arranged within the container, the collapsible liner comprising an aperture-defining liner fitment retained by the fitment retainer; a downwardly-extending dip tube arranged within the liner; and a connector including a probe defining a fluid flow passage therethrough, wherein a lower portion of the probe is arranged to directly engage an upper portion of the dip tube without an intervening dip tube coupling when the connector engages the neck of the rigid container; wherein the pressure dispensing apparatus further comprises at least one of the following features (a) and (b): (a) an inner diameter of a flow passage defined in the probe is at least about 65% of an inner diameter of a portion of the liner fitment arranged within the aperture of the fitment retainer; and (b) an inner diameter a flow passage defined in each of the probe and the dip tube is at least 0.62 inches.

In various embodiments, a method utilizes a pressure dispensing apparatus comprising (a) a rigid container including a neck defining a container opening, (b) a collapsible liner arranged within the container and comprising an aperture-defining liner fitment arranged in or along the neck of the rigid container, (c) a downwardly-extending dip tube arranged within the liner, and (d) a connector including a probe defining a fluid flow passage therethrough, the method comprising: threadably engaging the connector to the neck of the rigid container to cause a lower edge of the probe to directly engage an upper portion of the dip tube without an intervening dip tube coupling; and supplying pressurized gas through the connector to a compression space between the collapsible liner and the rigid container to compress the collapsible liner.

In some embodiments, a pressure dispensing apparatus comprises a container including a mouth along a top surface, an upper portion having a first width, and a lower portion having a second width that is smaller than the first width; a downwardly-extending dip tube including a liquid extraction opening arranged in the lower portion of the container; and at least one of the following features (a) and (b): (a) a reverse flow prevention element is arranged proximate to the liquid extraction opening to inhibit flow of liquid from the dip tube into the container; and (b) a sensor is provided in or proximate to the lower portion of the container to sense a condition indicative of absence or low level of liquid in the lower portion of the container.

In various embodiments, a method for reducing presence of bubbles within a fluid stream dispensed from a pressure dispense container comprises supplying pressurized gas to the interior of a rigid container to directly contact liquid chemical arranged within the interior, thereby causing liquid chemical to flow into the extraction opening of a dip tube, wherein the extraction opening is arranged within a lower portion of the container that comprises a reduced width relative to an upper portion of the container; and performing at least one of the following steps (a) and (b): (a) inhibiting backflow of the liquid chemical within the dip tube utilizing a reverse flow prevention element associated with the dip tube; and (b) sensing a condition indicative of absence or low level of liquid chemical in the lower portion of the container.

In some embodiments, a pressure dispensing apparatus comprises a container including a mouth along a top surface; a downwardly-extending dip tube including a liquid extraction opening arranged in the lower portion of the container; a gas inlet port arranged to communicate pressurized gas into an interior of the container to contact liquid arranged within the container; and a reverse flow prevention element arranged proximate to the liquid extraction opening to inhibit flow of liquid from the dip tube into the container.

Any one or more features of the foregoing embodiments and/or any other embodiments and features disclosed herein may be combined for additional advantage.

Other aspects, features and embodiments of the disclosure will be more fully apparent from the ensuing disclosure and appended claims.

DETAILED DESCRIPTION

Figure 1A:
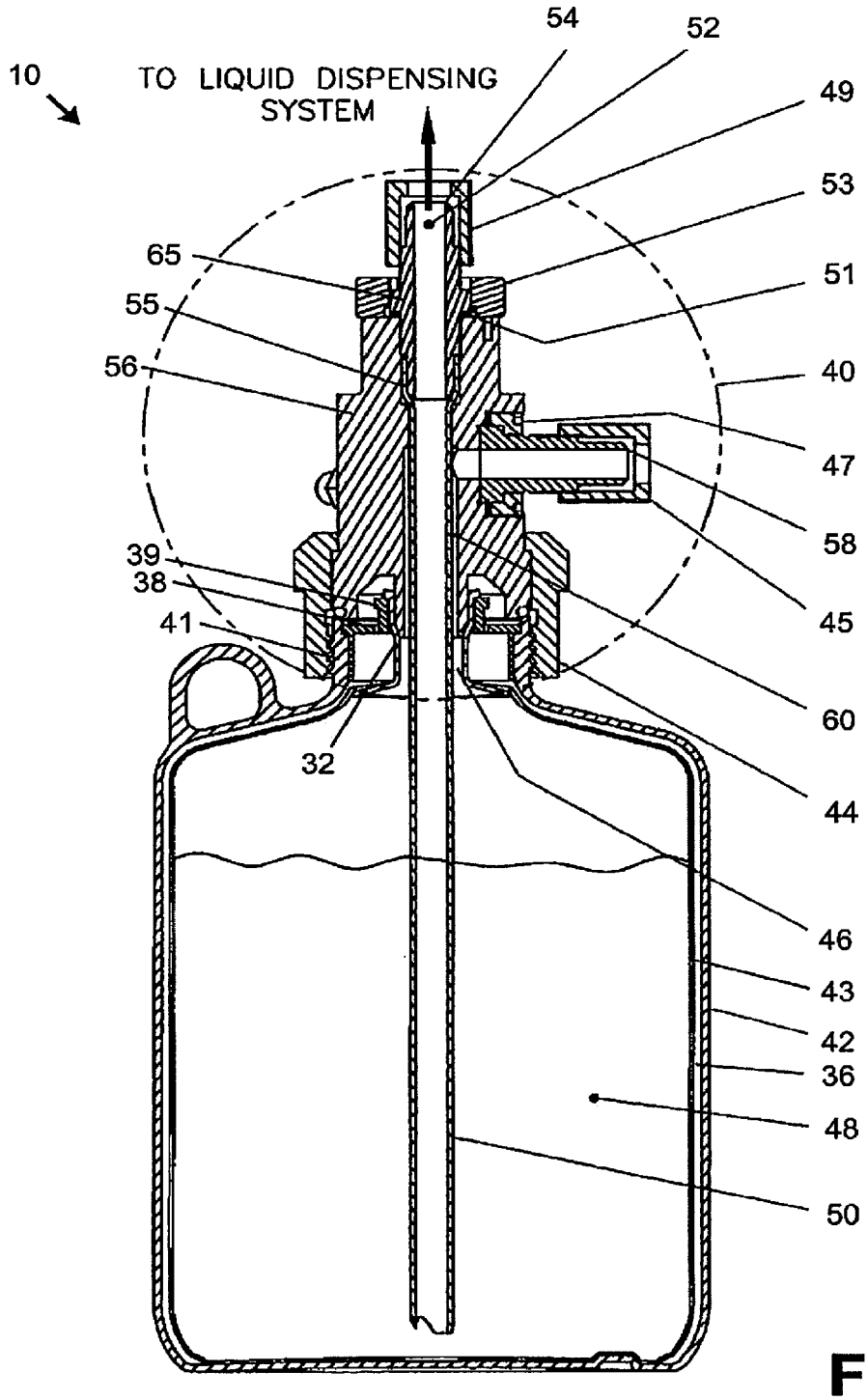
FIG. 1A (PRIOR ART)
FIG. 1A is a side cross-sectional view of a conventional fluid storage and dispensing apparatus including a liner-based pressure dispense package with a recirculating connector as disclosed in U.S. Pat. No. 7,025,234.
Figure 1B:
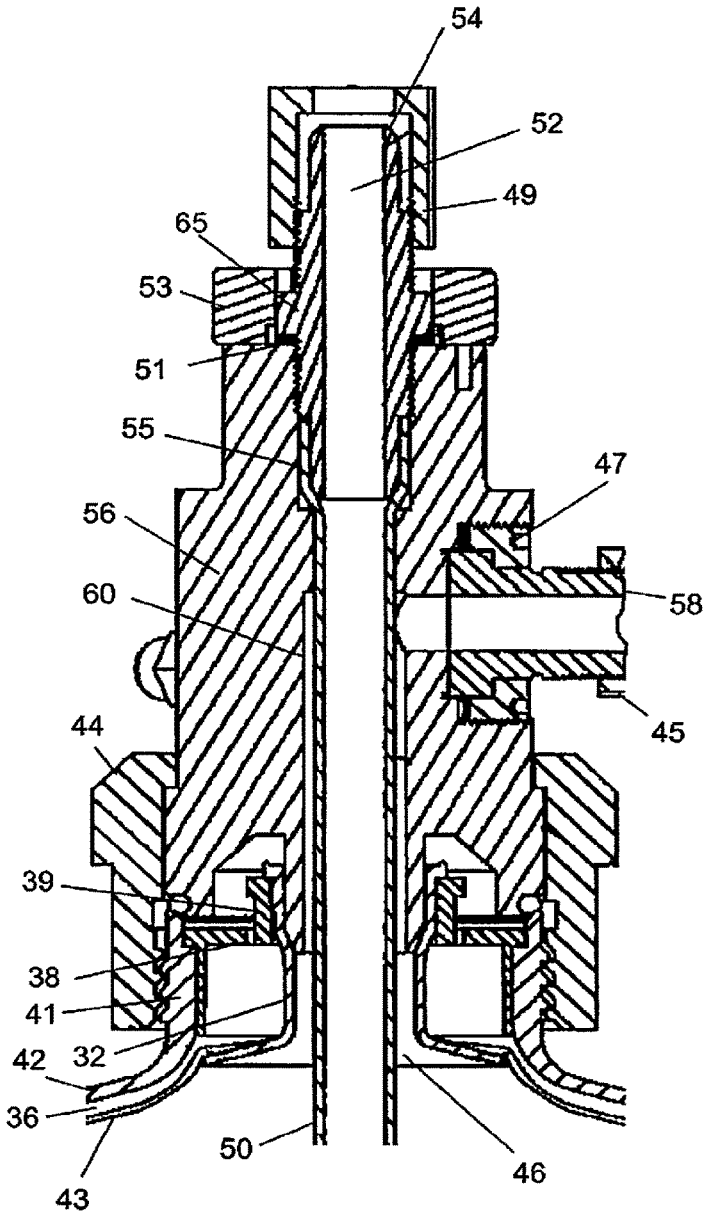
FIG. 1B (PRIOR ART)
FIGS. 1B-1C are magnified portions of the fluid storage and dispensing apparatus according to FIG. 1A.
Figure 1C:
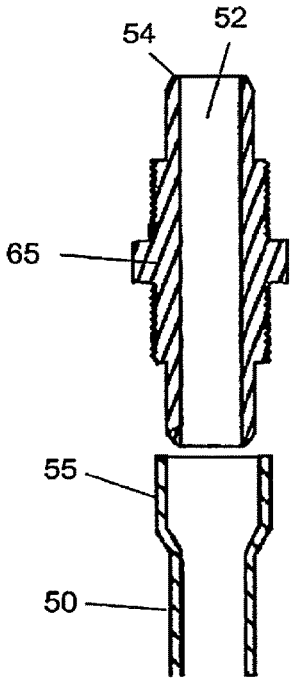
FIG. 1C (PRIOR ART)
Figure 2:
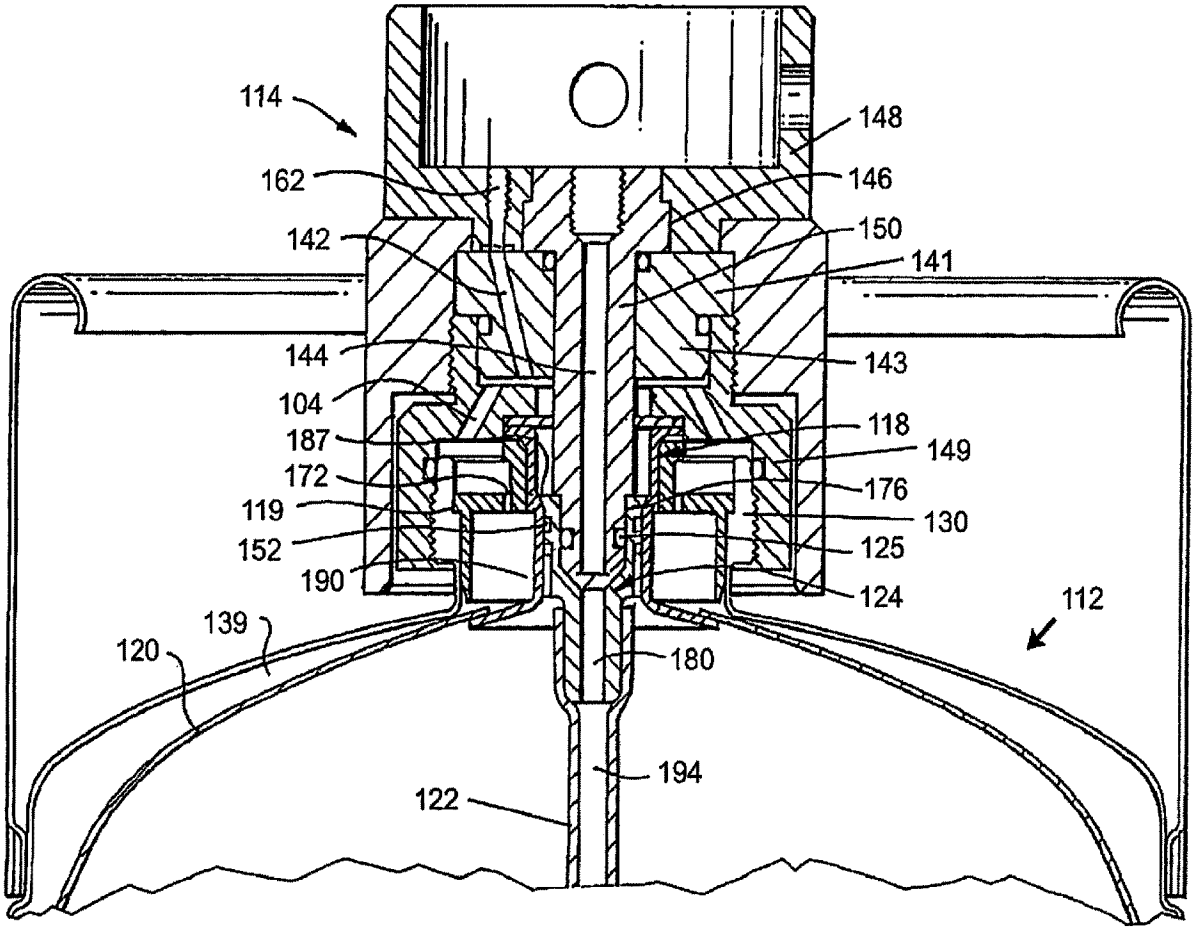
FIG. 2 (PRIOR ART)
FIG. 2 is a side cross-sectional view of a portion of another conventional fluid storage and dispensing apparatus including a liner-based pressure dispense package as disclosed in U.S. Pat. No. 5,435,460.

Referring to FIGS. 1A-1C (which are adapted from FIG. 2 of U.S. Pat. No. 7,025,234), an example of a liner-based pressure dispensing package including a recirculating probe is depicted. Such liner based containers for dispensing and circulating high viscosity liquids have been developed, but the requirement to provide both liquid extraction and liquid return ports restricts the potential size of the extraction path flow area to a relatively small fraction of the fitment opening. The package 10 includes an outer container 42, a liner 43 (containing liquid chemical 48) within the container 42 and including a fitment 32 supported by a fitment retainer 39, and a recirculating connector 40 arranged to mate with a neck 41 of the container 42. The fitment retainer 39 defines a gas passage 38 permitting pressurized gas to be admitted through the connector 40 into a compression space 36 between the container 42 and the liner 43. An upper portion of the connector 40 includes a probe 65 that is threaded into a connector body 56 (and retained by a nut 53), includes an outlet port 54 defining an outlet flow passage 52 (for receiving liquid chemical from the dip tube 50), and includes a retaining collar 49 for receiving an outlet line (not depicted). A medial surface of the probe 65 includes an O-ring 51 for sealing against the connector body 56, and a lower portion of the probe 65 is inserted into a widened upper portion 55 of the dip tube 50 that is arranged between the probe 65 and the connector body 56. A lower portion 44 of the connector 56 includes an internally threaded surface for mating with the neck 41 of the container 42. A side portion of the connector body 56 includes a recirculating port 58 affixed to the body 56 with a nut 47, and with a retaining collar 45 for receiving a recirculating line (not depicted). The connector body 56 defines a recirculation passage 60 arranged around a periphery of the dip tube 50 to permit recirculated liquid chemical to flow through opening 46 between the dip tube and the fitment 32 along an external surface of the dip tube 50 into the liner 43. U.S. Pat. No. 7,025,234 discloses that the inner diameter of the dip tube should be from 0.35 inch to 0.45 inch, the outer diameter of the dip tube should be from 0.45 inch to 0.55 inch, and the inner diameter of the recirculation passage 60 should be from 0.60 inch to 0.65 inch, wherein the flow area of the recirculation passage 60 should be the same as the flow area of the flow passage 52 within the dip tube 50 (each being approximately 0.1104 square inch).

Due to the need to provide the recirculation passage 60 around the periphery of the dip tube 50, the maximum flow area of the dip tube 50 is limited, thereby increasing pressure drop and reducing potential flow rate through the dip tube 50, particularly when very high viscosity liquid chemicals are dispensed. Additionally, the apparatus 10 according to FIGS. 1A-1C requires presence of a connection between the probe 65 and dip tube 50 to be made internal to the connector body 56 and outside the mouth of the container, such that it is impossible to for the dip tube to be shipped within a sealed container.

Otherwise, liner-based pressure dispensing containers conventionally employed with low viscosity materials may not be suitable for dispensing high viscosity materials, due to presence of relatively low flow areas of dispensing flow paths and/or presence of numerous transitions in flow area, thereby leading to increased backpressure and the potential need for impractically high pressures of pressurization gas (and further giving rise to a need for heavy gauge container materials for pressure containment).

Referring to FIG. 2 (which is adapted from FIG. 6 of U.S. Pat. No. 5,435,460), an example of such a conventional liner-based pressure dispensing package for low viscosity materials is presented. The package includes an outer container 112 containing a collapsible liner 120 having a fitment 118 mounted to a mouth 130 of the container 112 with a retainer 119 defining a gas passage 172. After the liner 120 is filled with liquid chemical, a dip tube 122 (defining liquid passage 194) and a dip tube coupling 124 (defining liquid passage 180) are inserted in the fitment 118. A cap and rupturable membrane (not depicted) may be arranged to seal the container 112 (e.g., with dip tube 122 and fitment retainer 119) for shipment. At a point of use, a connector 114 is engaged to the container 112. The connector 114 includes a lower body portion 141, a retainer 143, an upper body portion 148, an adapter portion 149, and a probe 146 that defines a flow passage 144 and that defines a groove for receiving an O-ring 125. The probe 146 including shaft portion 150 thereof may be inserted through a rupturable membrane (not depicted) covering the container mouth 130, which acts to release headspace gas within the liner 120. A lower end of the probe is inserted into a cavity 176 of the dip tube coupling 124 within the fitment 118, with the dip tube coupling 124 including an upper brim 187 and including an O-ring 152 along a perimeter thereof. Pressurized gas (e.g., air or nitrogen) is supplied through gas passages 162, 142, 104, 172, and 190 (with passage 190 embodying an annular recess) into a compression space 139 between the liner 120 and the container 112 to force liquid chemical up through dip tube 122, dip tube coupling 124, and probe 146 to connecting lines (not depicted) for conveying liquid chemical to a point of use.

As depicted in FIG. 2, the dip tube coupling 124 is intermediately connected between the probe 146 and the dip tube 122 with transitions between the foregoing components, and the liquid chemical flow path from the liner through the connector includes a reduction in flow area from the passage 194 defined in the dip tube 122 to the passages 180, 144 defined in the dip tube coupling 124 and probe 146, respectively. Such reduction in flow area would generate a significant pressure drop if the package of FIG. 2 were to be used for dispensing high viscosity liquid chemical. As a result, a conventional package according to the package of FIG. 2 is of limited utility.

The present disclosure relates to fluid and dispensing systems and methods that overcome various issues present in conventional recirculating and low viscosity material dispensing systems.

Figure 3A:
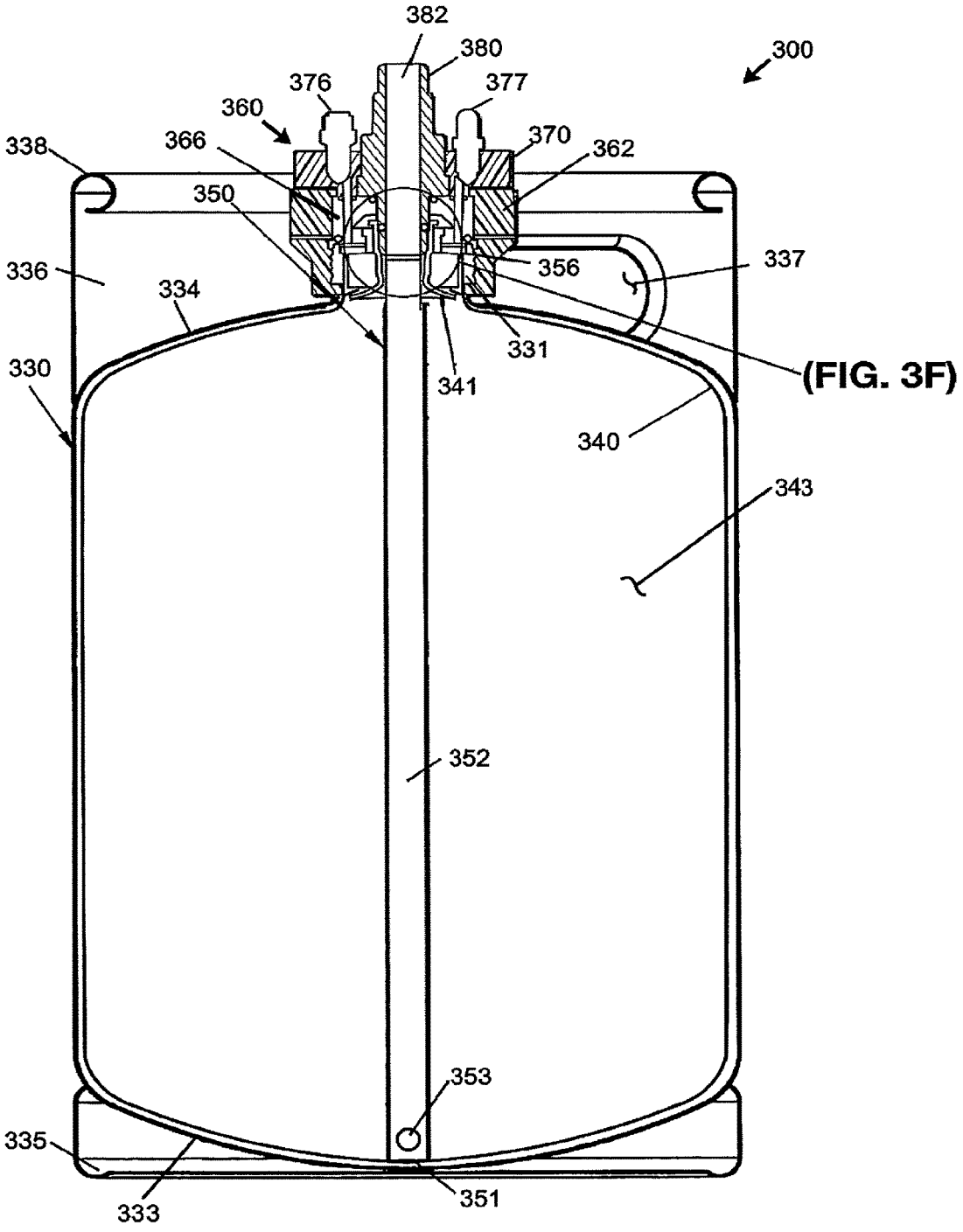
FIG. 3A is a side cross-sectional view of a fluid storage and dispensing apparatus including a liner-based pressure dispense package and connector according to one embodiment of the present disclosure.
Figure 3B:
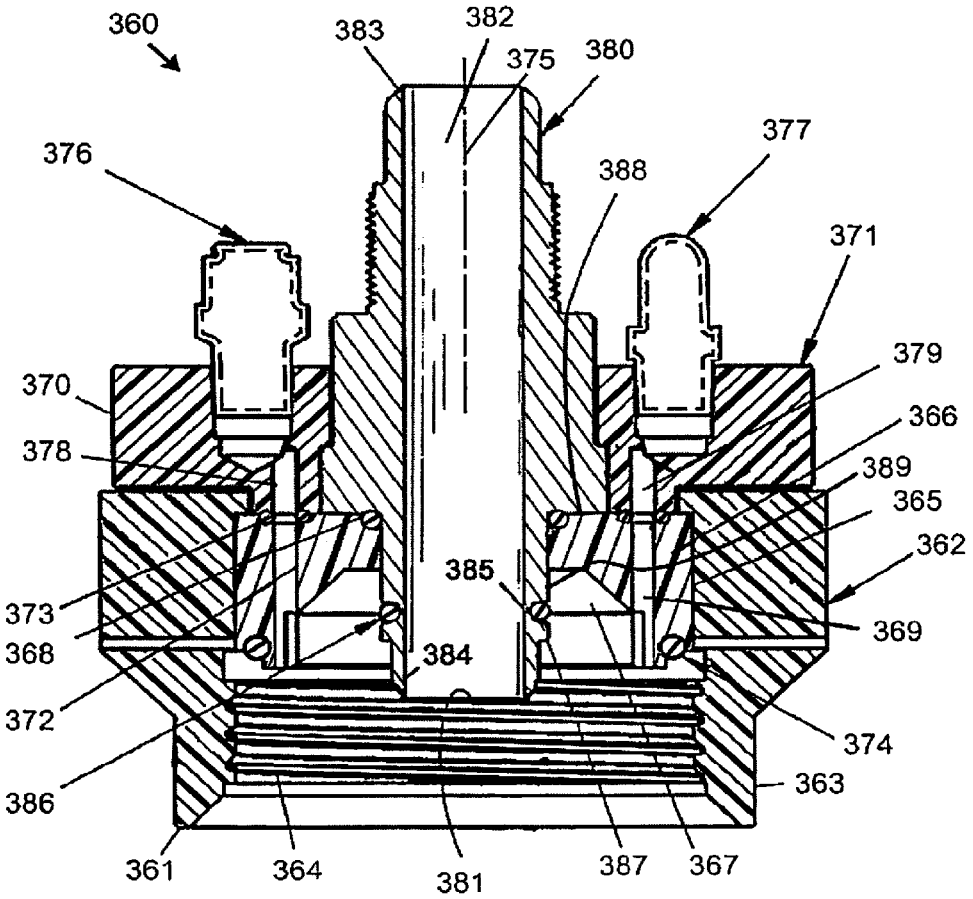
FIG. 3B is a magnified side cross-sectional view of the connector of FIG. 3A.
Figure 3C:
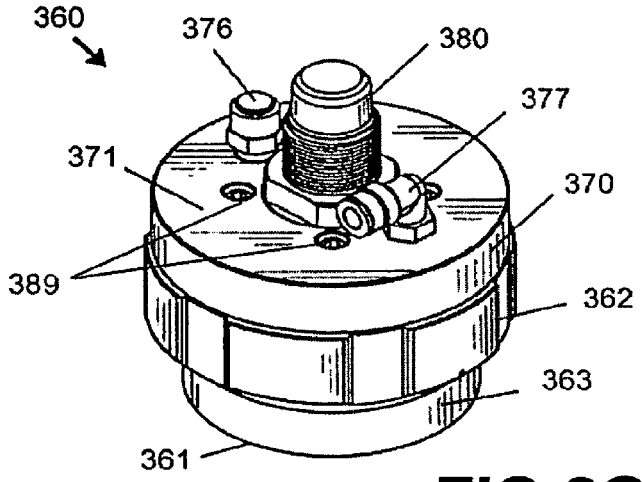
FIG. 3C is a perspective view of the connector of FIG. 3B.
Figure 3D:
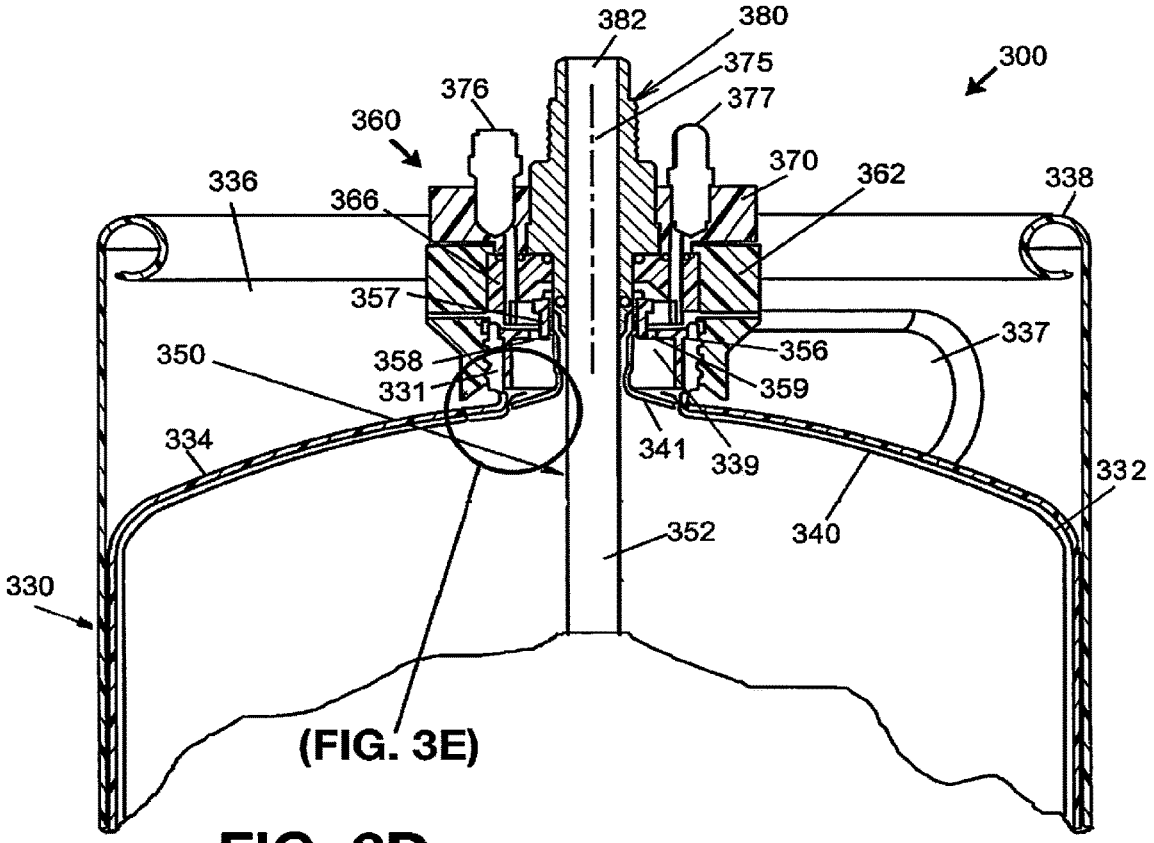
FIG. 3D is a magnified cross-sectional view of an upper portion of the fluid storage and dispensing apparatus of FIG. 3A.
Figure 3E:
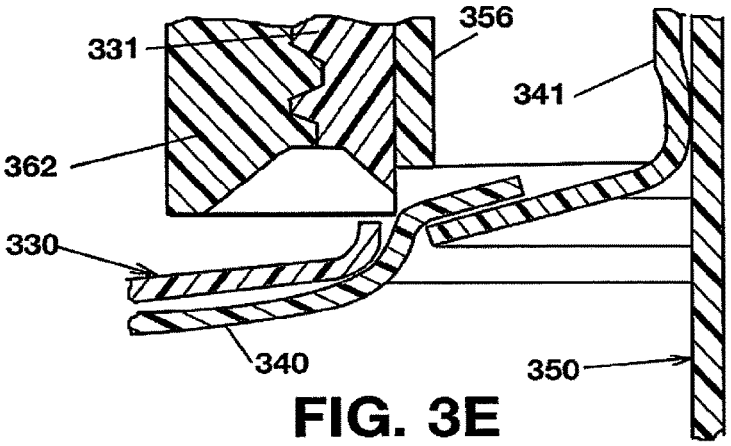
FIG. 3E is an enlarged, partial view of FIG. 3D in an embodiment of the disclosure.

Referring to FIG. 3A-3F, a fluid storage and dispensing apparatus 300 including a liner-based pressure dispense package (including a container 330, a liner 340, and a connector 360) is depicted in an embodiment of the disclosure. FIGS. 3B-3F illustrate the connector 360 separate from the container 300, with FIG. 3D providing an enlarged view of the dispensing apparatus 300, FIG. 3E presenting a close up of the attachment of the liner 340 to the fitment 341, and with FIG. 3F providing a further enlarged side cross-sectional view of a portion of the dispensing apparatus 300 of FIGS. 3A and 3D (e.g., depicting an interface between a connector probe 380, dip tube 350, and liner fitment 341).

As depicted generally to FIGS. 3A and 3D, the fluid storage and dispensing apparatus 300 includes a rigid or substantially rigid container 330 containing a collapsible liner 340 with a compression space 339 arranged between the container 330 and the liner 340. In one embodiment, the compression space 339 occupies with an annular region of the lower recess, the annular region begin defined between the body structure and the probe.

The container 330 can be rigid or substantially rigid in character, can include a lower cavity wall 333 and an upper cavity wall 334 bounding an interior volume 332, with lower and upper peripheral supporting walls 335, 336 extending beyond the lower and upper cavity walls 333, 334, and with an upper peripheral supporting wall optionally including an aperture 337 permitting use as a carry handle. The upper peripheral supporting wall 336 may optionally be terminated at a rolled upper lip 338. The liner 340 bounds an interior volume 343 that may include a liquid-containing material (e.g., optionally overlaid with headspace that may include inert gas). An aperture-defining fitment 341 bounds an upper opening of the liner 340, with an upper end of the fitment 341 retained by a fitment retainer 356 intermediately arranged between the dip tube 350 and the container neck 331. The fitment retainer 356 includes a raised fitment retainer neck 357, and includes gas passages 358, 359 arranged in fluid communication with gas passages 368, 369, respectively, defined in the internal probe retainer 366. An upper end of the fitment 341, which can be flared, is arranged to contact an upper surface 354 of the raised fitment retainer neck 357. The dip tube 350 extends into an interior of the liner 340 and includes an internal liquid passage 352, an upper portion 355 that can be widened or flared, a lower end 351, and an optional liquid ingress lower side opening 353 (proximate to lower end 351).

As depicted generally to FIGS. 3A-3D, the connector 360 is coupled to the container 330, with an internally threaded lateral wall 363 of the connector 360 affixed to the container neck 331. The connector 360 includes an upper connector body 370, an internal (probe) retainer 366 arranged to retain a probe 380, and a lower connector body 362. The upper connector body 370 includes apertures defined in the top surface 371 thereof for receiving a pressure relief valve 376 and a pressurization gas tube fitting 377, and further defines gas passages 378, 379 in fluid communication with the pressure relief valve 376 and pressurization gas tube fitting 377, respectively. The upper connector body 370 can be coupled to the lower connector body 362 with fasteners 389. The probe 380 defines an internal flow passage 382 that is concentric about a central axis 375 and is retained between the upper connector body 370 and the internal retainer 366, with an O-ring or other sealing element 372 provided between the probe 380 and internal retainer 366 along an interface surface 388. The internal retainer 366 defines gas passages 368, 369 that serve as extensions of the passages 378, 379 defined in the upper connector body 370, with O-rings or other sealing elements 373 provided at transitions between the respective pairs of gas passages 368-378 and 369-379. The internal retainer 366 further defines a recess 367 that receives a portion of the probe 380. The lower connector body 362 abuts the upper connector body 370 and surrounds a lateral wall 365 of the internal retainer 366, with an O-ring or other sealing element 374 arranged between the lower connector body 362 and the internal retainer 366. A lower recess 364 of the lower connector body 362 is threaded along an internal surface of a lateral wall 363, with the lower recess 364 of the lower connector body 362 being continuous with the recess 367 of the internal retainer 366. A lower edge 361 of the lower connector body 362 bounds an opening of the lower recess 364. A lower portion of the probe 380 protrudes into the recesses 367, 364, with a lower end 381 of the probe 380 arranged in the lower recess 364 above the lower end 361 of the lower connector body 362. A lower tip 381 of the probe 380 is bounded along an outer radius thereof to define a tapered face 384 that is inclined with respect to the central axis 375 of the probe 380. In one embodiment, the tapered face 384 defines a chamfered surface. An outer wall 389 of the probe 380 defines a recess 385 arranged to receive an O-ring or other sealing element 386, with the recess 385 being bounded from below by a locally widened travel stop portion 387.

Figure 3F:
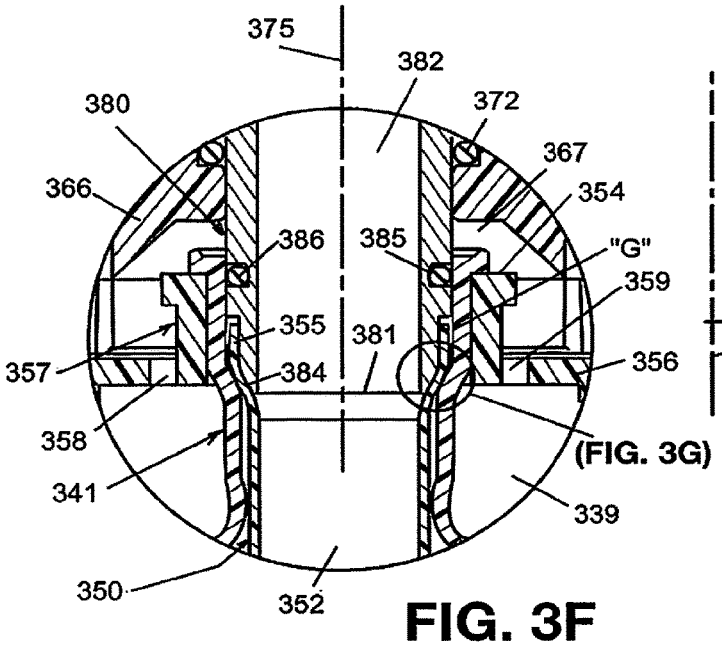
FIG. 3F is a further magnified side cross-sectional view of a portion of the apparatus of FIGS. 3A and 3D depicting an interface between the connector probe, dip tube, and liner fitment.

As depicted generally to FIGS. 3D-3F, the upper portion 355 of dip tube 350 is arranged within the fitment 341, with the fitment 341 being retained by the fitment retainer 356. In one embodiment, after the liner 340 of the container 330 is filled with liquid chemical through the fitment 341, the dip tube 350 is inserted into the fitment 341, and a threaded cap (e.g., caps 800, 850, or shipping probe assembly 870, described attendant to FIGS. 8-10) is affixed to the container neck 331 to seal the liquid chemical and dip tube 340 within the liner 340 and container 330 for shipping. Thereafter, the capped container is transported to a point of use (e.g., facility for fabricating electronic devices), whereupon the previously-affixed cap is, in some embodiments, removed, and the connector 360 is mated with the container 330. (In other embodiments, such as with shipping probe assembly 870, no removal of a cap is necessary, as discussed below attendant to FIG. 10.) As the internally threaded lateral wall 363 of the connector 360 is mated with the container neck 331, a reduced wall thickness lower (male) end 381 of the probe 380 is inserted into the upper (female) portion 355 of a dip tube 350. The upper portion 355 of the dip tube 350 can be widened (e.g., flared). As the upper portion 355 of the dip tube 350 is received by the lower end 381 of the probe 380, the tapered face 384 of the probe 380 is arranged to depress or seat a surface of the upper portion 355 of the dip tube 350 against an inner surface of the fitment 341 to sealingly engage the dip tube 341 between the probe 360 and the fitment 341.

In one embodiment, a slight lateral gap "G" is provided between the upper end of the dip tube and the inner wall surface of the fitment 341. Functionally, the gap "G" augments seating of the upper portion 355 of the dip tube 350 within the fitment 341 by enabling the dip tube 350 to seat without being bound up on the interior surface of the right cylindrical portion of the upper portion 355.

In operation, as the internally threaded lateral wall 363 of the connector 360 is mated with the container neck 331, the lower end 381 of the probe 380 is brought into contact with the upper portion 355 of the dip tube 350. In one embodiment, tightening the connector 360 relative to the container neck 331 causes the tapered face 384 of the probe 380 to translate downward and exert a force on the upper portion 355 of the dip tube 350. The force can plastically deform (e.g., leave an indentation in) the fitment 341 to promote positive sealing. Lateral sealing between the outer wall 389 of the probe 380 and an internal wall of the fitment 340 is also promoted by the O-ring or other sealing element 386.

Figure 3G:
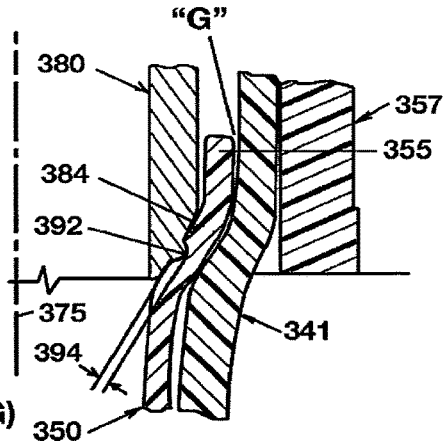
FIG. 3G is an enlarged cross-sectional view of a stress concentrator disposed on a probe in an embodiment of the disclosure.
Figure 3H:
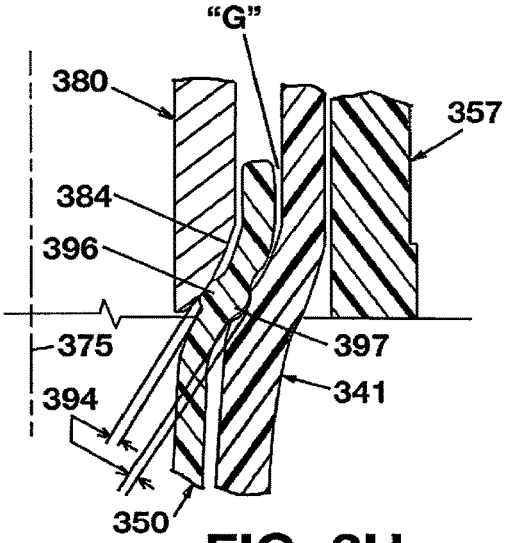
FIGS. 3H and 3I are enlarged cross-sectional views of alternative stress concentrator arrangements in embodiments of the disclosure.
Figure 3I:
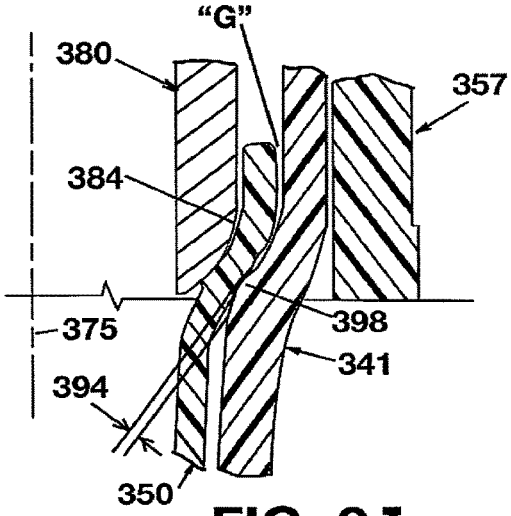

Referring to FIGS. 3G-3I, stress concentration arrangements for enhanced sealing between the probe 380, dip tube 350, and fitment 341 are presented in embodiments of the disclosure. In FIG. 3G, an optional rib portion 392 that protrudes from the tapered face 384 is depicted. The rib portion 392 is continuous about the central axis 375 and projects a distance 394 normal to the tapered face 384 to engage with the upper portion 355 of the dip tube 350. In FIG. 3H, an alternative arrangement utilizing one or both of rib portions 396 and 397 on the upper portion 355 of the dip tube 350 is depicted, each being characterized as protruding the distances 394 normal to the tapered mating surfaces.

Functionally, the rib portion 392 of FIG. 3G, when implemented, provides a stress concentrator that enhances the integrity of the seal between the tapered face 384 and the upper portion 355 of the dip tube 350. Essentially, the stress concentrator is an interference fit to the flared upper portion 355 of the dip tube that provides a positive seal. The stress concentrator can enhance the integrity of the seal by overcoming variance of surface angle/flatness of the flared mating surface of the upper portion 355 of the dip tube 350, resulting in improved seal between both components. The local deformation caused on the interior surface of the upper portion 355 can also cause deformation on the exterior surface of the upper portion 355, thereby enhancing the integrity of the seal between the upper portion 355 and the fitment 341.

After the connector 360 is affixed to the container 330, dispensing of liquid within the liner 340 may be accomplished by flowing pressurized gas through the pressurization gas tube fitting 377, through gas passages 379, 369 defined in the connector 360, and though gas passage 359 defined in the fitment retainer 356 to pressurize the compression space 339 arranged between the container 330 and the liner 340. Application of pressure to the compression space 339 serves to compress (and progressively collapse) the liner 340 and thereby pressurize liquid chemical contained within the liner 340. Such action forced liquid chemical from the liner 340 through the liquid ingress opening 353 of the dip tube 350 upward into the internal liquid flow passage 352, and into and through the liquid flow passage 382 of the probe 380 to be discharged into outlet piping (not depicted) connected to the upper end 383 of the probe 380 to be conveyed a point of use (e.g., a liquid-utilizing process tool). If gas pressure within the compression space 339 exceeds a predetermined setpoint pressure of the pressure relief valve 376, then the pressure relief valve 376 will automatically open and permit pressurization gas to leave the compression space 339 through gas passage 358 defined in the fitment retainer 356 and gas passages 368, 378 defined in the connector 360 to be discharged through the pressure relief valve 376.

In one embodiment, an inner diameter of the flow passages 352, 382 defined in the dip tube 350 and the probe 380, respectively, is at least 0.62 inches. Internal dimensions of flow passages 352, 382 defined in the dip tube 350 and the probe 380, respectively, can be matched in flow area (e.g., with variation in diameter or flow area of less than about 5%, less than about 3%, less than about 2%, less than about 1%, less than about 0.5%, or less than about 0.1%), to reduce potential pressure drop along the transition between the dip tube 350 and probe 380 to prevent formation of bubbles in the dispensed liquid.

After an empty condition or an approach to empty condition is sensed (wherein liquid contents of the liner-based container are substantially exhausted), the connector 360 (including probe 380) may be disengaged from the container neck 331, and the connector 360 may be connected to another (liquid-filled) liner-based container of substantially identical type to the container 330 to continue dispensation of liquid to the point of use from the other container. In certain embodiments, liquid-containing material may continue to be supplied to the liquid-utilizing process from an optional downstream reservoir while a new liner-based pressure dispense container is readied for dispensing operation.

It is noted that, while the probe 380 is depicted as being a metal, use of polymeric materials is also an option. Likewise, various other components in the figures are depicted as being of a polymeric material, but can optionally be of a metallic material. For example, the upper connector body 370 and lower connector body 362 are often metallic (e.g., aluminum alloy or stainless steel), and the container 330 is often metallic (e.g., stainless steel).

Figure 4:
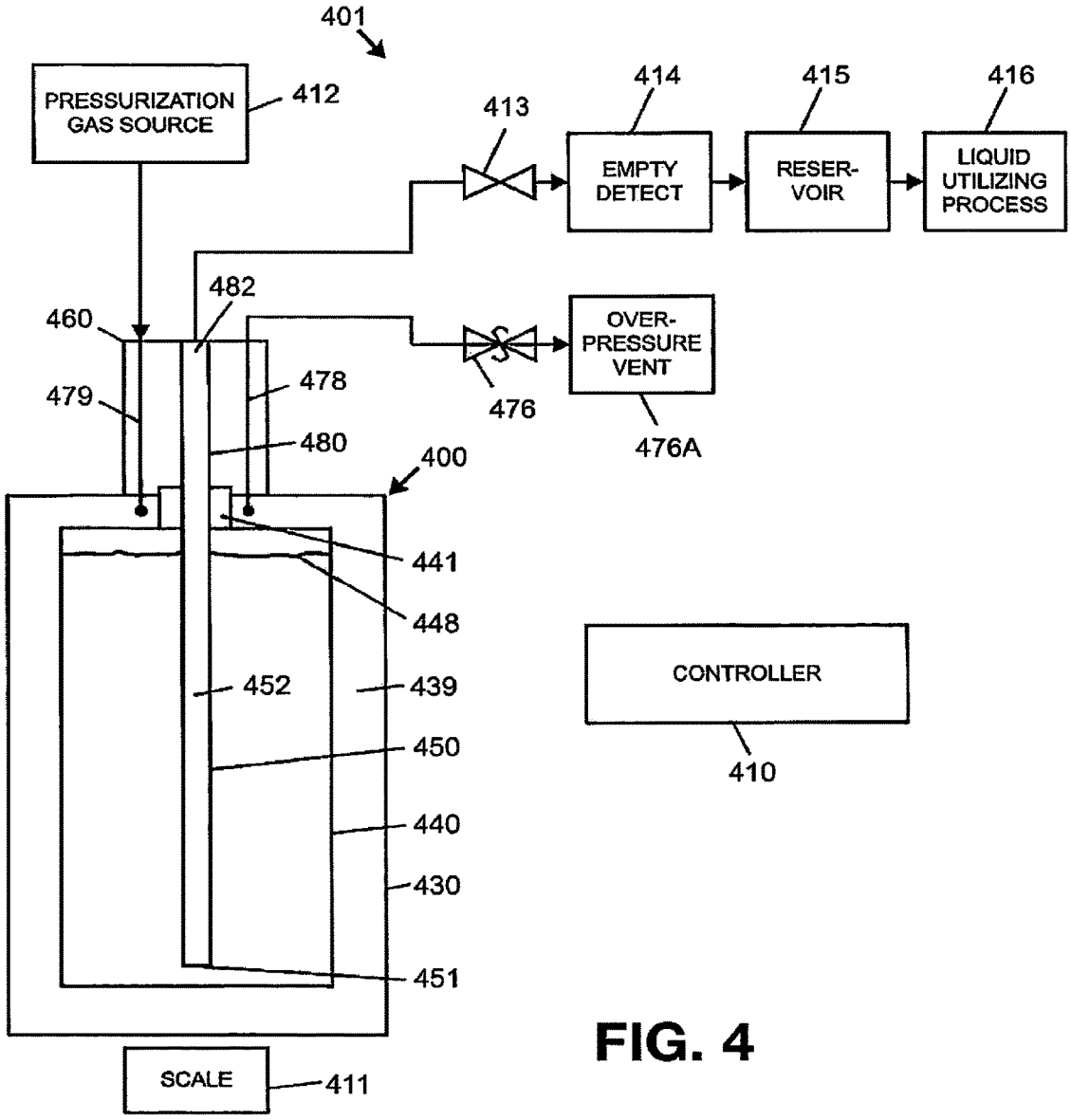
FIG. 4 is a simplified schematic view of a fluid handling system arranged for dispensing a liquid-containing material from a fluid storage and dispensing apparatus including a liner-based pressure dispense package according to FIG. 3A.

Referring to FIG. 4, a fluid handling system 401 for dispensing liquid-containing material (e.g., liquid chemical) from a fluid storage and dispensing apparatus 400 is schematically depicted in an embodiment of the disclosure. In the depicted embodiment, the dispensing apparatus includes a container 430 and a collapsible liner 440. A dip tube 450 extends downward from a liner fitment 441 into an interior of the liner 440 in contact with liquid 448 contained in the liner 440. The dip tube 450 is elongated in character, includes a liquid flow passage 452, and includes a lower end 451 serving as a liquid extraction point proximate to the bottom of the liner 440. A compression space 439 between the liner 440 and the container 430 is in fluid communication with (i) a pressurization gas source 412 by way of a first gas passage 479 in the connector 460, and (ii) a pressure relief valve 476 (and overpressure vent 476A) by way of a second gas passage 478 in the connector 460. The connector 460 further includes a probe 480 defining a liquid flow passage 482 arranged in fluid communication with, and, in one embodiment, having the same flow area as, the liquid flow passage 452 defined in the dip tube 450. Downstream of the liquid flow passage 482 defined in the probe 480, a control valve 413, an empty detect sensor 414, and a reservoir 415 may be provided upstream of a liquid-utilizing process (or process tool) 416. The empty detect sensor 414 may include a pressure transducer arranged to sense pressure of the dispensed liquid to detect a pressure droop condition (characteristic of liner-based pressure dispensing) indicative of an approaching empty condition. Alternatively, the empty detect sensor 414 may embody one or more level sensors arranged to sense level in the (optional) reservoir 415 intermediately arranged between the liner 440 and the liquid-utilizing process or process tool 416. The reservoir 415 may include a bottom outlet for extraction of liquid and a top outlet permitting ventilation of gas. To supplement or supplant the foregoing empty detection elements, a scale 411 may be provided to sense weight of the container 430 and its contents, with a change in weight being useful to determine when liquid contents of the liner 440 are exhausted or nearly exhausted. A controller 410 may be arranged to receive inputs from one or more sensors, arranged to control operation of one or more valves or other flow control elements, arranged to control a pressurization gas source, and arranged to control operations such as starting and stopping of fluid dispensing, adjust fluid flow rate, changing of pressure dispense containers upon depletion, notify operators of abnormal conditions, manage material inventory requirements, and/or control or affect operation of a liquid-utilizing process tool.

Figure 5:
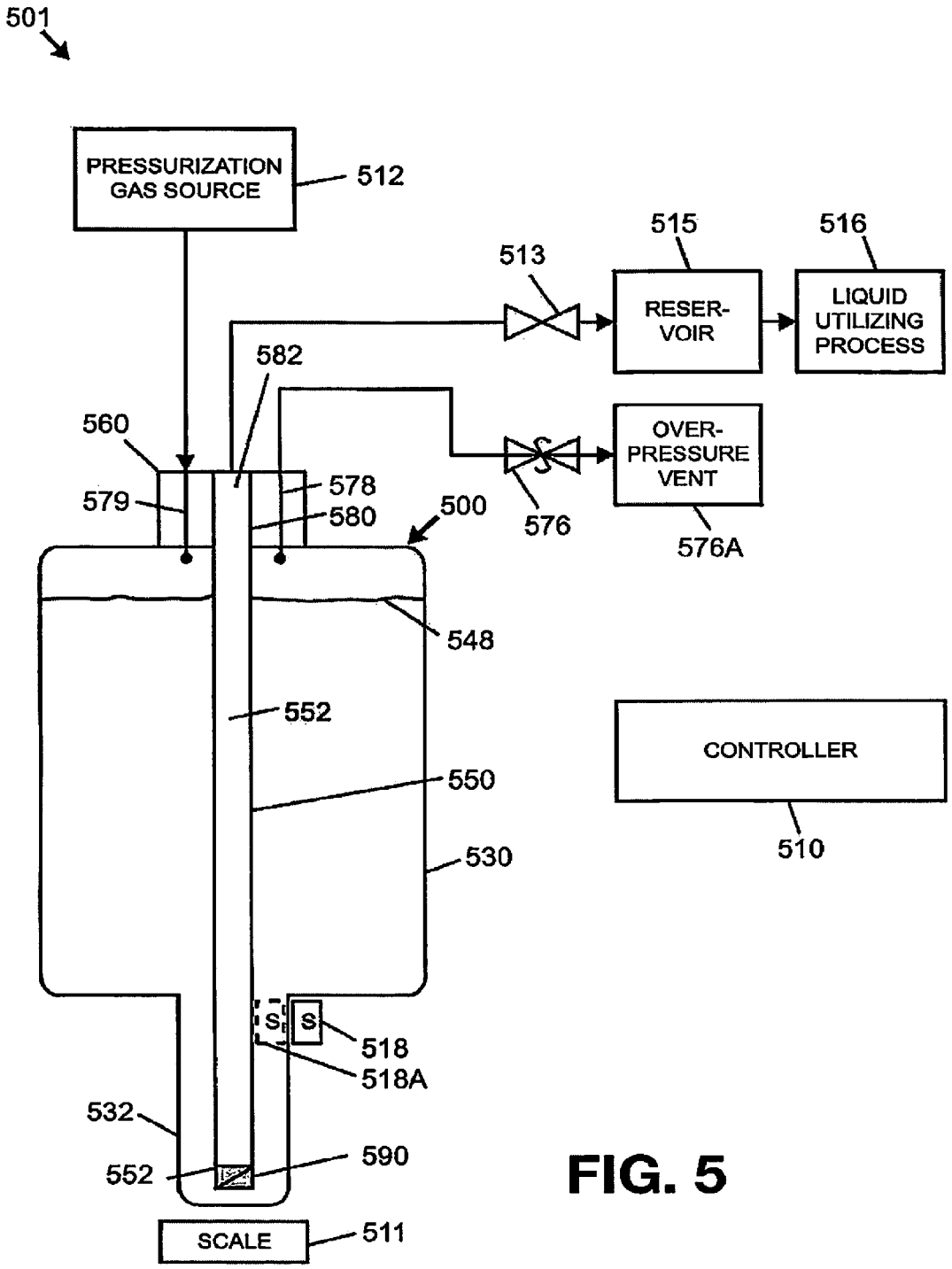
FIG. 5 is a simplified schematic view of a fluid handling system arranged for dispensing a liquid-containing material from a fluid storage and dispensing apparatus including a liner-less pressure dispense container with a reduced width lower portion, a reverse flow prevention element, and at least one sensor element arranged to sense a condition indicative of absence or low level of liquid in the lower portion of the container.

Referring to FIG. 5, a fluid handling system 501 arranged for dispensing a liquid or liquid-containing material 548 from a liner-less fluid storage and dispensing apparatus 500 is schematically depicted in an embodiment of the disclosure. The liner-less fluid storage and dispensing apparatus 500 can include a container 530 with a reduced width lower portion 532, a reverse flow prevention element 590 associated with a dip tube 552, and at least one sensor element 518, 518A arranged to sense a condition indicative of absence or low level of liquid in the lower portion 532 of the container 530. In certain embodiments, a sensor element 518 is arranged solely outside the container 530 (e.g., proximate to the reduced width portion 532); in other embodiments, at least one sensor element or portion thereof 518A may be arranged within (or in fluid communication with) the reduced width portion 532 of the container 520. A dip tube 550 extends downward into an interior of the container 520 into contact with liquid or liquid-containing material 548 contained therein. The dip tube 550 is elongated in character, includes a liquid flow passage 552, and includes a lower end 551 serving as a liquid extraction point proximate to the bottom of the reduced width lower portion 532 of the container 540. In one embodiment, a reverse flow prevention element 590 (e.g., float valve, butterfly check valve, or other valve element) is associated with the dip tube 552, proximate to the liquid extraction opening at the lower end 551, and serves to inhibit flow of liquid from the dip tube 550 into the container 530.

The interior of the container 530 is in fluid communication with (i) a pressurization gas source 512 by way of a first gas passage 579 in the connector 560, and (ii) a pressure relief valve 576 (and overpressure vent 576A) by way of a second gas passage 578 in the connector 560. The connector 560 further includes a probe 580 defining a liquid flow passage 582 arranged in fluid communication with, and can have the same flow area as, the liquid flow passage 552 defined in the dip tube 550. Downstream of the liquid flow passage 582 defined in the probe 580, a control valve 513 and reservoir 515 (which may optionally include one or more associated empty detect sensors, such as one or more level sensors) may be provided upstream of a liquid-utilizing process (or process tool) 516. A reservoir 515 may be intermediately arranged between the container 530 and the liquid-utilizing process or process tool 516; such reservoir 515 may include a bottom outlet for extraction of liquid and a top outlet permitting ventilation of gas. The reservoir 515 may optionally include one or more level sensors arranged to sense liquid level therein. To supplement or supplant the foregoing empty detection elements, a scale 511 may be provided to sense weight of the container 530 and its contents, with a change in weight being useful to determine when liquid contents of the container 530 are exhausted or nearly exhausted. A controller 510 may be arranged to receive inputs from one or more sensors, arranged to control operation of one or more valves or other flow control elements, arranged to control a pressurization gas source, and arranged to control operations such as starting and stopping of fluid dispensing, adjust fluid flow rate, changing of pressure dispense containers upon depletion, notify operators of abnormal conditions, manage material inventory requirements, and/or control or affect operation of a liquid-utilizing process tool.

Figure 6A:
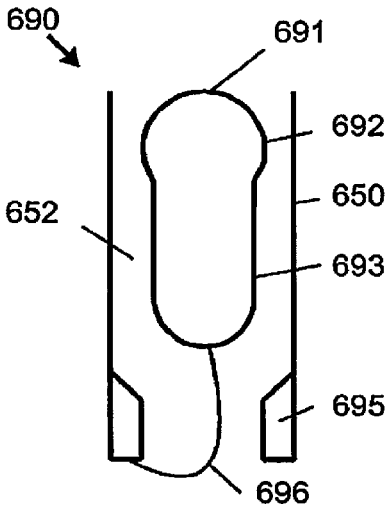
FIGS. 6A-6B illustrate side schematic cross-sectional views of a reverse flow prevention element in the form of a float valve in an open position and a closed position, respectively.
Figure 6B:
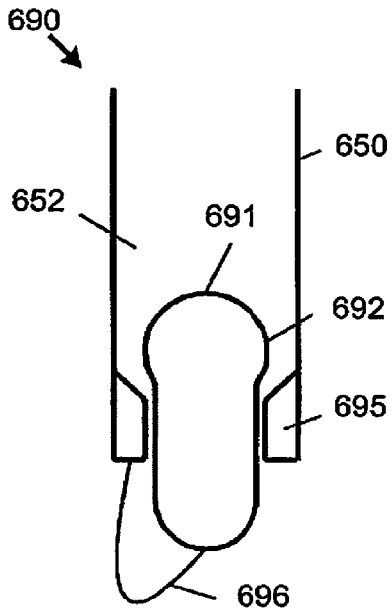

Referring to FIGS. 6A-6B, side schematic cross-sectional views of a reverse flow prevention element is illustrated in an embodiment of the disclosure. In the depicted embodiment, the reverse flow prevention element is in the form of a float valve 690 in an open position and a closed position, respectively. A floating element 691 within a liquid flow passage 652 includes a reduced width lower portion 693 and an increased width upper portion 692 arranged to cooperate with a valve seating element 695 associated with a dip tube 650 or extension thereof. An optional tether 696 may be arranged to prevent egress of the floating element 692. As illustrated in FIG. 6A, when liquid is flowing upward in the liquid flow passage 652, the floating element 691 rises upward relative to the valve seating element 695, thereby opening a gap under and around the floating element 691 through which liquid may be extracted from the interior of a container through the dip tube 650. Conversely, when upward flow of liquid ceases, gravity (or reverse flow of liquid) may pull the floating element 691 downward within the liquid flow passage 652 to cause the increased width upper portion 692 to contact the valve seating element 695 and inhibit downward (i.e., reverse) flow of liquid from the dip tube 650 into an associated container, thereby reducing introduction of bubbles into liquid in the container.

Figure 7A:
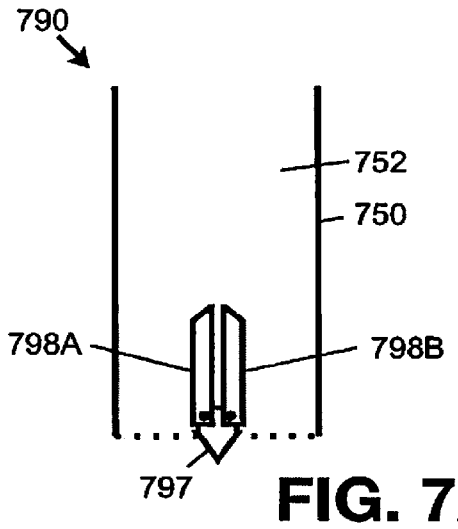
FIGS. 7A-7B illustrate side schematic cross-sectional views of a reverse flow prevention element in the form of a butterfly check valve in an open position and a closed position, respectively.
Figure 7B:
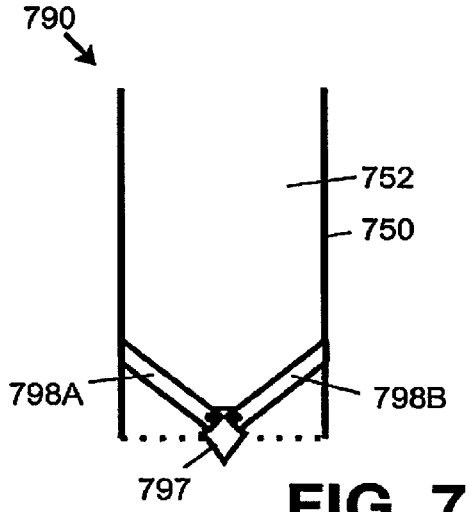
Figure 7C:
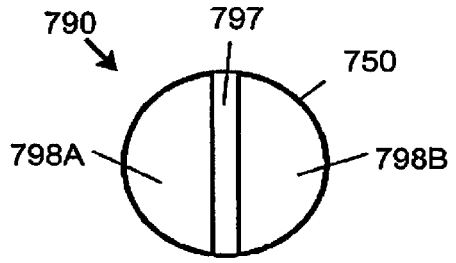
FIG. 7C illustrates a top plan view of a butterfly check valve according to FIGS. 7A-7B in a closed position.

Referring to FIGS. 7A-7C, a reverse flow prevention element is illustrated in an embodiment of the disclosure. In this depiction, the reverse flow prevention element is in the form of a butterfly check valve 790, illustrated in an open position and a closed position in FIGS. 7A and 7B, respectively, and in a closed position in FIG. 7C. A lateral support 797 spans the width of a dip tube 750 and supports first and second hinged semi-circular flap elements 798A-798B arranged to cooperate with walls of the dip tube 750. As depicted in FIG. 7A, when liquid is flowing upward in the liquid flow passage 752, the flap elements 798A-798B swing upward to an open position, thereby opening gaps through liquid may be extracted from the interior of a container through the dip tube 750. Conversely, when upward flow of liquid ceases, gravity (or reverse flow of liquid) may pull the flaps 798A-798B downward to contact interior walls of the dip tube 750 and inhibit downward (i.e., reverse) flow of liquid from the dip tube 750 into an associated container, thereby reducing introduction of bubbles into liquid in the container.

Figure 8:
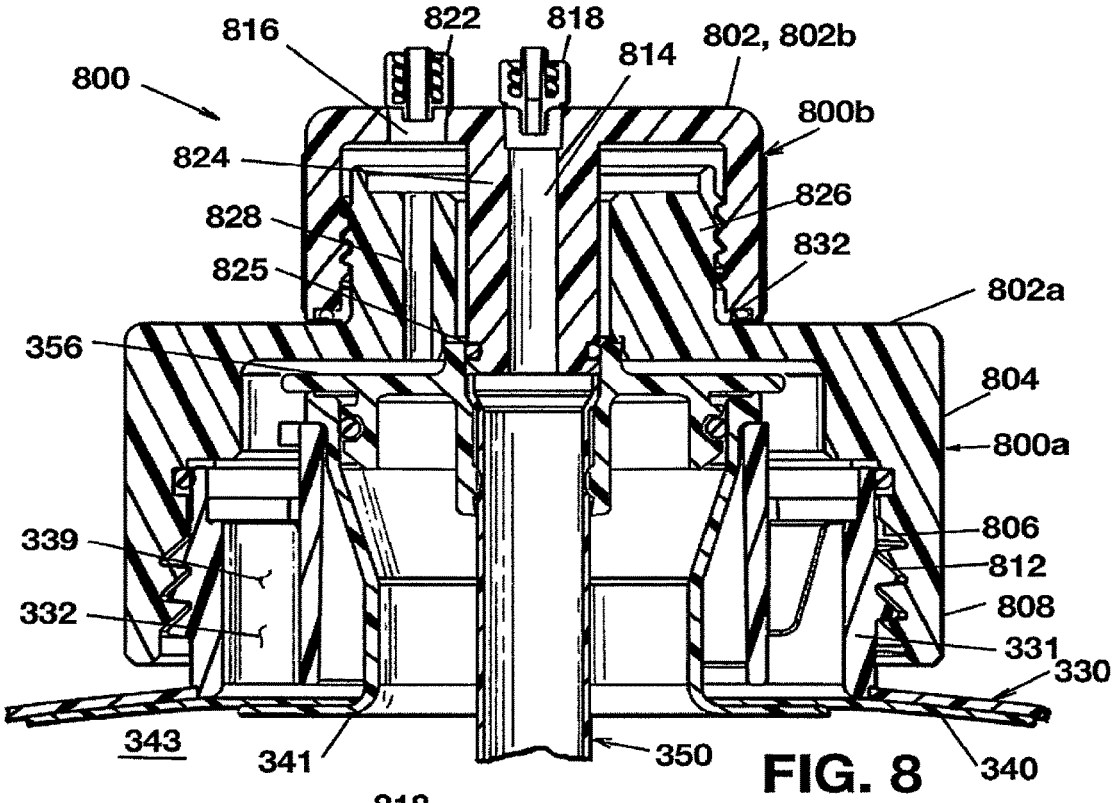
FIG. 8 is a partial cross-sectional view of a two-port cap in assembly in an embodiment of the disclosure.

Referring to FIG. 8, a two-port cap 800 is depicted in an embodiment of the disclosure. The two-port cap 800 comprises a top portion 802 from which a skirt portion 804 depends. The skirt portion 804 can comprise an inner surface 806 and an outer surface 808 and can include threads 812 formed thereon for coupling with the container neck 331. The top portion 802 further defines a dispense port 814 and a pressurization port 816. The dispense port 814 is in fluid communication with the interior volume 343 of the liner 340. The pressurization port 816 is in fluid communication with the interior volume 332 of the container 330 and the external surface 342 of the liner 340.

The dispense port 814 and the pressurization port 816 can each be terminated on the top portion 802 with fittings 818 and 822, respectively. The fittings 818 and 822 can accommodate caps or plugs that can be installed or removed, such as with Luer fittings, for selective access to the container 330. In some embodiments, one or both of the fittings 818 and 822 can accommodate valves for selective isolation of one or more of the dispense port 814 and the pressurization port 816. In one embodiment, a stem portion 824 depends from the top portion 802, to engage or nearly engage the dip tube 350. The stem portion 824 can define the dispense port 814, and can include an elastomeric seal 825 proximate a distal end, for example an O-ring disposed in a properly sized gland, that forms a seal between the stem portion 824 and the retainer neck 357 of the fitment retainer 356.

In one embodiment, the two-port cap 800 is bifurcated into a base portion 800*a* and a closure portion 800*b*, each having its own top portion 802*a* and 802*b*, respectively. In the depicted embodiment of FIG. 8, such bifurcated arrangement is utilized. In this embodiment, the base portion 800*a* includes a neck portion 826 that extends upwards into the closure portion 800*b*, the neck portion 826 also defining a bypass 828 that enables fluid communication between the pressurization port 816 and the interior volume 332 of the container. The closure portion 800*b* can be coupled to the base portion 800*a*, for example, by threaded engagement (as depicted). An elastomeric seal 832 can be disposed between the closure portion 800*b* and the top portion 802*a* of the base portion 800*a*, for example by an O-ring seated in a gland as depicted.

Functionally, the two-port cap 800 can be utilized to remove headspace gas from the liner 340 filled with liquid and replace the headspace gas with an inert gas such as nitrogen, for storage or transport. The stem portion 824 extends the seal 825 down into the fitment 341 for isolation of the dispense port 814 and dip tube 350 from areas external to the stem portion 824. The bifurcated arrangement enables caps designed for smaller containers, such as the connector 360 of FIGS. 3A through 3G, to be adapted to larger containers by providing a larger, appropriately sized based cap 800*a*.

In operation, the liner 340, disposed in the container 330, is filled with a liquid and the dip tube 350 inserted into the liquid filled liner 340 and coupled to the fitment 341. The two-port cap 800 is secured to the container neck 331. With the dispense port 814 open, the pressurization port 816 can be pressurized, causing the liquid filled liner 340 to partially contract and causing the headspace gas to be pushed outward through the dispense port 814. The gas used to pressurize the pressurization port 816 can be any appropriate gas, such as air or an inert gas. It is noted that, in various embodiments, the stem portion 824 does not contact or inhibit vertical motion of the dip tube 350; accordingly, any headspace gas that is located external to the dip tube 350 can escape into the retainer neck 357 of the fitment retainer 356 for expunging through the dispense port 814.

An inert gas supply is then connected to the dispense port 814, and the pressurization port 816 exposed to ambient. Exposure of the pressurization port 816 to ambient can cause inert gas from the inert gas supply to be drawn into the dispense port 814. In one embodiment, the inert gas supply is controlled to a predetermined pressure above ambient, for example, 1 or 2 psig. By this technique, the headspace gas originally present in the liner after the fill operation is replaced or substantially replaced with the inert gas. The dispense port 814 and, optionally, the pressurization port 816 can then be capped for shipping or storage.

Figure 9:
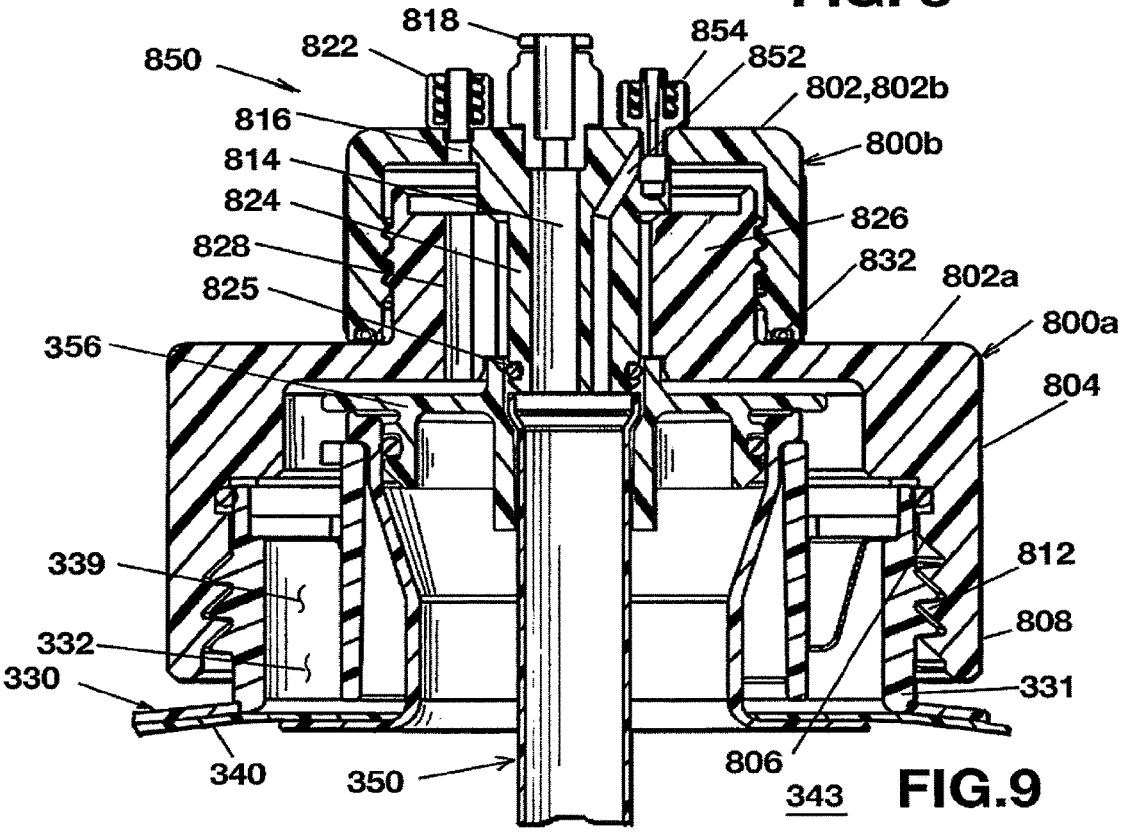
FIG. 9 is a partial cross-sectional view of a three-port cap in assembly in an embodiment of the disclosure.

Referring to FIG. 9, a three-port cap 850 is depicted in an embodiment of the disclosure. The three-port cap can include many of the same characteristics and attributes as the two-port cap 800, which are indicated with same-numbered numerical references. In addition, the three-port cap 850 includes a separate inert gas port 852 that is in fluid communication with the interior volume 343 of the liner 340. For embodiments that utilize the stem portion 824, the inert gas port 852 can be defined therein, as depicted in FIG. 9. The inert gas port 852 can be terminated on the top portion 802 with a fitting 854 that can be capped, such as Luer fittings, which accommodates caps or plugs that can be installed or removed for selective access to the interior volume 343 of the liner 340.

In operation, the liner 340, disposed in the container 330 with the liner 340 empty. The dip tube 350 is inserted into the empty liner 340 and coupled to the fitment 341. The three-port cap 850 is secured to the container neck 331. The liner 340 can then be cycled (collapsed and inflated) one time by first applying pressure to the pressurization port 816 to collapse the liner about the dip tube 350, then removing the pressure from the pressurization port 816 and inflating the liner via the inert gas port 852. Typically, the inflation is performed with an inert gas. Inert gas can also be applied to the inert gas port 852 at a low but positive pressure, for example 1 or 2 psig. In one embodiment, the inert gas supply is controlled to this positive pressure, to assure that the liner is completely filled with gas. After pressurizing the liner 340 to the low pressure, the liner 340 is filled with liquid that is applied through the dispense port 814. In one embodiment, the pressure for the liquid fill is applied at a pressure that is higher than ambient to assure a positive pressure is maintained on the liner 340 during the fill, thereby mitigating entry of ambient air into the liner 340. After the fill operation is complete, the dispense port 814, inert gas port 852, and, optionally, the pressurization port 816 can be capped for shipping or storage.

Figure 10:
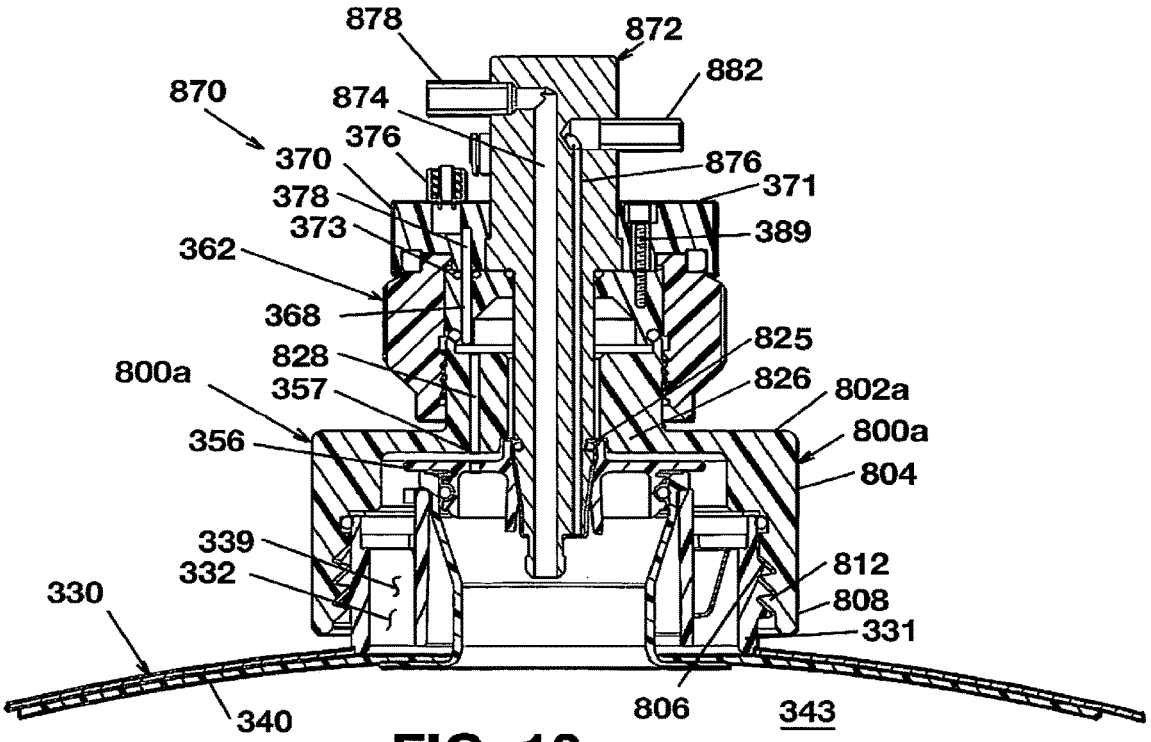
FIG. 10 is a partial cross-sectional view of a shipping probe assembly in an embodiment of the disclosure.

Referring to FIG. 10, a shipping probe assembly 870 for filling and removing non-inert gases from the liner 340 is depicted in an embodiment of the disclosure. The shipping probe assembly 870 includes components similar to other embodiments disclosed herein, including the base cap 800*a* of the two- and three-port caps 800 and 850, as well as the connector 360 (both upper connector body 370 and lower connector body 362) and the internal retainer 366. These components include many (but not necessarily all) of the same features and attributes as previously described, which are indicated in FIG. 10 with same-numbered numerical references.

In addition, the shipping probe assembly 870 includes a gas removal probe 872 that can be substituted for the probe 380 of the dispensing apparatus 300 (e.g., FIG. 3D). The gas removal probe 872 defines a liquid fill port 874 and an inert gas port 876, which can be terminated exteriorly with connectors 878 and 882, respectively. The gas removal probe 872 is captured and secured to the shipping probe assembly 870 in the same manner that the probe 380 is captured within the connector 360 of FIG. 3B. The gas removal probe 872 can also include the stress concentrator (e.g., rib portion 392) such as depicted in FIG. 3G.

Functionally, the shipping probe assembly 870 enables the liner to be filled and headspace gas to be removed or replaced with an inert gas in a manner identical or similar to that outlined above for the three-port cap 850. In addition, the gas removal probe 872 can be the same as the probes utilized for dispensing of fluid to a tool or dispensing system, providing ready connection to the tool or dispensing system.

Each of the caps 800 and 850, and the shipping probe assembly 870, are depicted in assembly with the container 330 and with the fitment 341 and liner 340. It is understood, however, that each of the caps 800 and 850, and shipping probe assembly 870, can be considered exchangeable, and therefore each constitutes a standalone component or system that can be provided separate from the container 330, fitment 341, and liner 340.

Embodiments disclosed herein can provide one or more of the following beneficial technical effects: reducing pressure drop (or backpressure) in dispensation of liquids—especially high viscosity liquids; improved integrity of mechanical connections between connectors and liner-based containers; simplified manufacture of dispensing apparatuses; enablement of shipment of dip tube components inside liner-based pressure dispense containers with liners containing liquid chemical; reduced reverse flow of liquid chemical from dip tubes (thereby inhibiting bubble formation); reduced pressure requirements for pressurization gas (e.g., in liner-less embodiments), and improved detection of near-exhaustion of liquid chemical from a dispensing container.

While inventions have been described herein in reference to specific aspects, features and illustrative embodiments of the disclosure, it will be appreciated that the utility of an invention is not thus limited, but rather extends to and encompasses numerous other variations, modifications and alternative embodiments, as will suggest themselves to those of ordinary skill in the field of the disclosure. Any one or more features described in connection with one or more embodiment(s) are contemplated to combined with one or more features of any other embodiment(s), unless specifically indicated to the contrary herein. Correspondingly, the inventions as hereinafter claimed are intended to be broadly construed and interpreted, as including all such variations, modifications and alternative embodiments, within its spirit and scope.

Each of the additional figures and methods disclosed herein can be used separately, or in conjunction with other features and methods, to provide improved devices and methods for making and using the same. Therefore, combinations of features and methods disclosed herein may not be necessary to practice the disclosure in its broadest sense and are instead disclosed merely to particularly describe representative embodiments.

Various modifications to the embodiments may be apparent to one of skill in the art upon reading this disclosure. For example, persons of ordinary skill in the relevant art will recognize that the various features described for the different embodiments can be suitably combined, un-combined, and re-combined with other features, alone, or in different combinations. Likewise, the various features described above should all be regarded as example embodiments, rather than limitations to the scope or spirit of the disclosure.

Persons of ordinary skill in the relevant arts will recognize that various embodiments can comprise fewer features than illustrated in any individual embodiment described above. The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

References to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

What is claimed is:

1. A connector for a liner-based pressure dispensing apparatus, comprising:

a body structure including an internally threaded lateral wall arranged to cooperate with an externally threaded portion of the neck of a rigid container, the body structure defining a lower recess proximate to the internally threaded lateral wall;

an internal retainer disposed in the body structure, the internal retainer defining a recess in fluid communication with the lower recess of the body structure;

a probe defining a fluid flow passage therethrough, wherein a lower portion of the probe extends into the lower recess for operative coupling with an upper portion of a dip tube, the lower portion of the probe having a tapered face that is inclined with respect to a central axis of the probe; and structure defining at least one gas flow passage arranged to enable fluid communication between an exterior surface of the connector and the lower recess, wherein the lower portion of the probe is configured to directly contact the upper portion of the dip tube for seating the upper portion of the dip tube against an inner surface of a fitment to sealingly engage the dip tube between the probe and the fitment when the connector is mated with the liner-based pressure dispensing apparatus.

2. The connector of claim 1, wherein a circumferential sealing element is arranged along an outer wall of the probe above the lower portion in order to engage a fitment retainer when the connector is mated with the liner-based pressure dispensing apparatus.

3. The connector of claim 1, wherein at least the lower portion of the probe comprises metallic material for engagement with the dip tube, wherein the dip tube is of a polymeric material.

4. The connector of claim 3, wherein the at least one gas flow passage comprises a first gas flow passage and a second gas flow passage, each being fluid communication with an annular region of the lower recess, the annular region defined between the body structure and the probe.

5. The connector of claim 3, further comprising a pressure relief valve in fluid communication with the second gas flow passage.

6. The connector of claim 1, wherein the probe includes a stress concentrator that extends radially outward from an outer surface of the lower portion of the probe for engagement with the dip tube.

* * * * *